US010238957B2

(12) United States Patent
Rodems

(10) Patent No.: US 10,238,957 B2
(45) Date of Patent: Mar. 26, 2019

(54) GAME APPARATUS WITH MATCHED OUTER AND INNER VESSELS AND METHOD OF PLAYING

(71) Applicant: Robert Rodems, Springfield, IL (US)

(72) Inventor: Robert Rodems, Springfield, IL (US)

( * ) Notice: Subject to any disclaimer, the term of this patent is extended or adjusted under 35 U.S.C. 154(b) by 0 days.

(21) Appl. No.: 15/273,658

(22) Filed: Sep. 22, 2016

(65) Prior Publication Data

US 2017/0080328 A1 Mar. 23, 2017

Related U.S. Application Data

(60) Provisional application No. 62/293,401, filed on Feb. 10, 2016, provisional application No. 62/222,380, filed on Sep. 23, 2015.

(51) Int. Cl.

| | |
|---|---|
| ***A63B 67/00*** | (2006.01) |
| ***A63F 9/00*** | (2006.01) |
| ***A63F 1/04*** | (2006.01) |
| ***A63F 5/04*** | (2006.01) |
| ***A63F 11/00*** | (2006.01) |
| *A63F 9/16* | (2006.01) |

(52) U.S. Cl.

CPC ..... *A63F 9/001* (2013.01); *A63F 1/04* (2013.01); *A63F 5/04* (2013.01); *A63F 11/0011* (2013.01); *A63F 2009/0012* (2013.01); *A63F 2009/165* (2013.01); *A63F 2011/0016* (2013.01); *A63F 2250/04* (2013.01); *A63F 2250/0407* (2013.01)

(58) Field of Classification Search

CPC ..... A63F 9/001; A63F 2009/0012; A63F 2009/0013; A63F 2009/0053; A63F 1/04; A63F 2250/04; A63F 2250/0407; A63F 2250/0414

USPC ..... 273/139, 140, 141 R, 142 HA

See application file for complete search history.

(56) References Cited

U.S. PATENT DOCUMENTS 990,439 A * 4/1911 Hill ..... A63F 7/044 273/109

2,345,781 A * 4/1944 Wiedemann ..... G07F 17/3213 273/138.5

(Continued)

*Primary Examiner* — Melba Bumgarner
*Assistant Examiner* — Joseph B Baldori
(74) *Attorney, Agent, or Firm* — Wendy Thai

(57) ABSTRACT

The invention provides a game apparatus having matched inner and outer vessels and a set of cards that can be used to play a game. Each vessel of the game apparatus is configured to hold a liquid such as water or beer, which can be dispensed into the vessel body through the open top. The outer vessel is larger than the inner vessel and configured to hold the inner vessel in a substantially upright position and rotatable in its hollow interior. The matched inner and outer vessels can be used to play a game in which two or more players take turn adding at least a drop of water to an inner vessel placed in a fluid-filled outer vessel until a player loses by causing the inner vessel to sink by adding more fluid than the inner vessel can hold. The invention also provides a plurality of karma cards that are content matched to a two-vessel game apparatus. A karma card can stipulate one or more actions to be taken when a player causes the inner cup to sink to a position identified by an outcome element on the outer cup. The invention methods for playing games using the matched two-vessel game apparatus, as well as score cards.

20 Claims, 23 Drawing Sheets

(56) References Cited

U.S. PATENT DOCUMENTS

| | | | | | |
|---|---|---|---|---|---|
| 2,788,976 | A * | 4/1957 | Bascle, Jr. | A63F 5/04 | 273/141 R |
| 2,813,720 | A * | 11/1957 | Bascle | A63F 5/02 | 273/109 |
| 3,136,460 | A * | 6/1964 | Ruderian | A45F 5/02 | 224/249 |
| 3,163,426 | A * | 12/1964 | Ruderian | A63F 5/04 | 273/142 R |
| 3,980,306 | A * | 9/1976 | Tollefson | A63F 5/02 | 273/109 |
| 4,127,271 | A * | 11/1978 | Moustakas | A63B 67/06 | 273/336 |
| 5,039,101 | A * | 8/1991 | Potter | A63F 7/048 | 273/144 B |
| 5,390,933 | A * | 2/1995 | Kraus | A63F 3/00031 | 273/141 R |
| 5,725,212 | A * | 3/1998 | Garrett | A63F 7/045 | 273/138.2 |
| 6,322,072 | B1 * | 11/2001 | Mair | A63F 11/0011 | 273/141 R |
| 6,367,801 | B1 * | 4/2002 | Spencer | A63F 7/045 | 273/457 |
| 9,668,599 | B1 * | 6/2017 | Ellsworth | B65D 51/24 | |
| 2004/0227285 | A1 * | 11/2004 | Lee | A63F 9/001 | 273/138.2 |
| 2015/0343318 | A1 * | 12/2015 | Liang | A63H 1/00 | 446/259 |

* cited by examiner

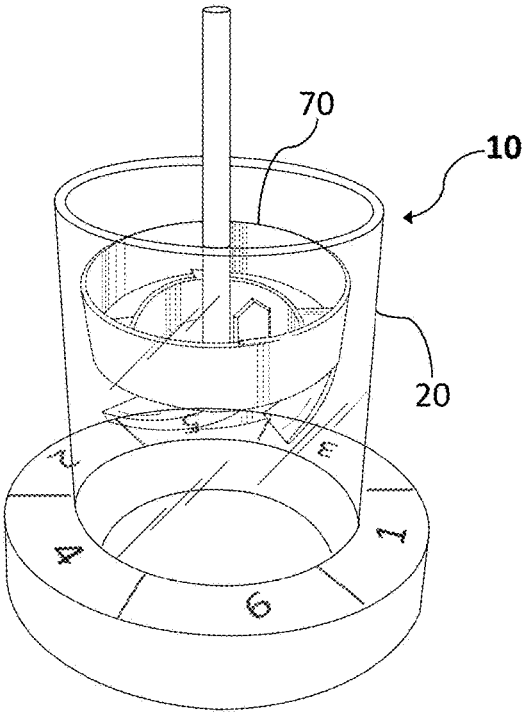
FIG. 1A
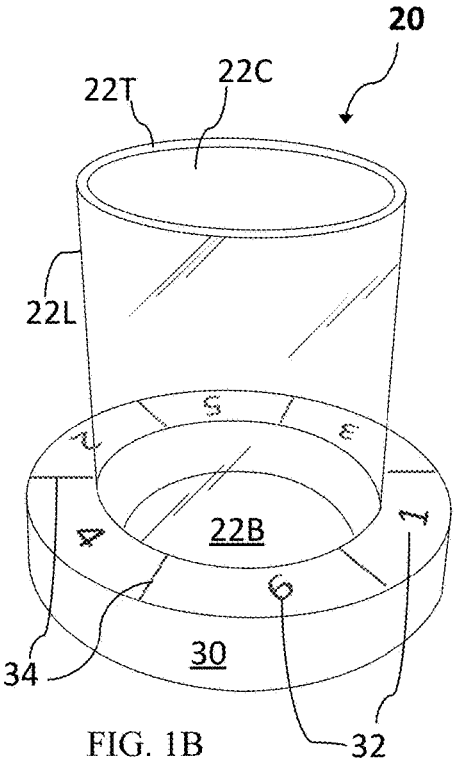
FIG. 1B
FIG. 1C
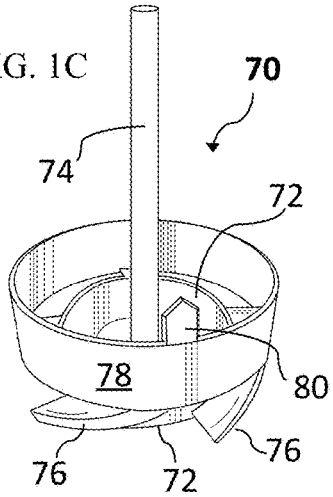
FIG. 1D
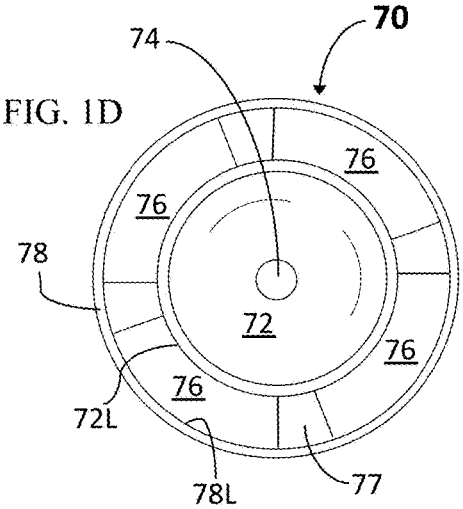

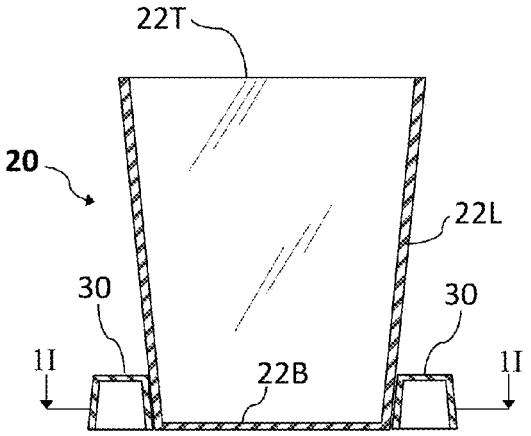
FIG. 1H
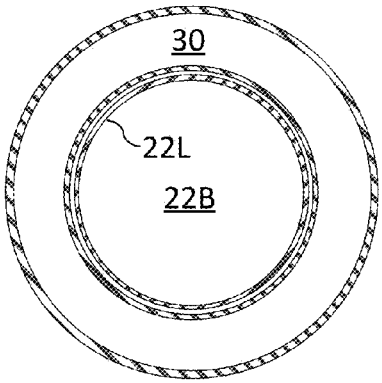
FIG. 1I
FIG. 1J
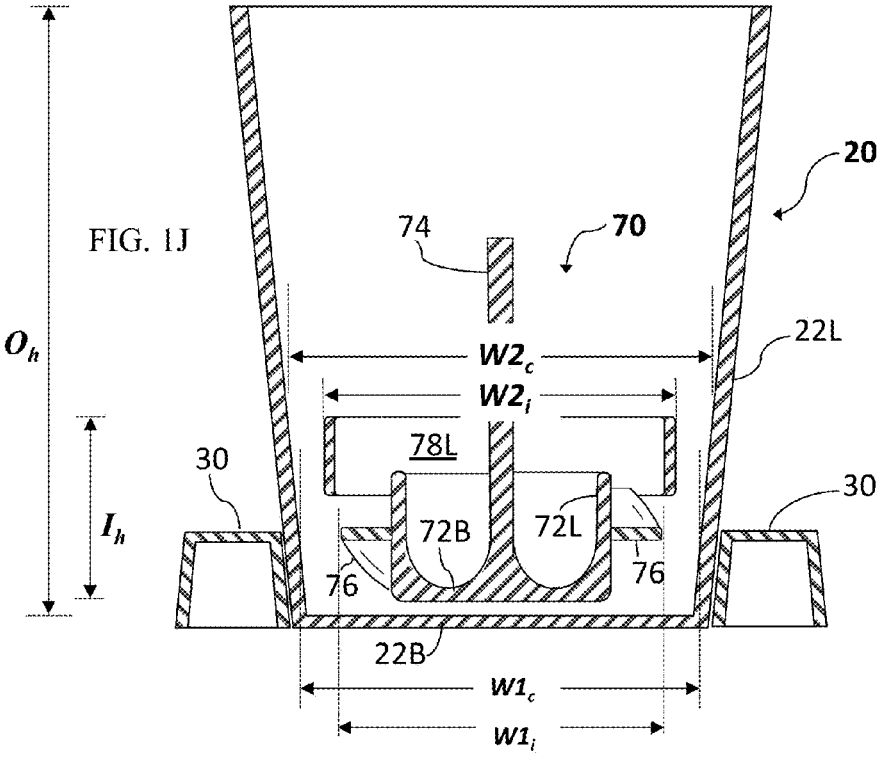

615

SCORE TABLE

| | Player 1 | Player 2 | Player 3 | Player 4 | Player 5 | Player 6 |
|---|---|---|---|---|---|---|
| Initials | | | | | | |
| Round 1 | | | | | | |
| Round 2 | | | | | | |
| Total | | | | | | |
| Round 3 | | | | | | |
| Total | | | | | | |
| Round 4 | | | | | | |
| Total | | | | | | |
| Round 5 | | | | | | |
| Total | | | | | | |
| Round 6 | | | | | | |
| Total | | | | | | |
| Round 7 | | | | | | |
| Total | | | | | | |
| Round 8 | | | | | | |
| Total | | | | | | |
| Round 9 | | | | | | |
| Total | | | | | | |
| Round 10 | | | | | | |
| Total | | | | | | |
| Round 11 | | | | | | |
| Total | | | | | | |
| Round 12 | | | | | | |
| Total | | | | | | |
| Round 13 | | | | | | |
| Total | | | | | | |
| Round 14 | | | | | | |
| Total | | | | | | |

FIG. 8B

701

Wet Karma

Pick another player to give you a Wet Willy.

If you or the other player refuse, the number the cup landed on is how many drinks you both must take.

706

ANIMAL KARMA

Run around the room and act like an animal. The cup decides what animal.

1 = Dog
2 = Chicken
3 = Monkey
4 = Dog
5 = Chicken
6 = Monkey

If you refuse, the number the cup landed on is how many drinks you must take

702

TURD KARMA

All players must call you "turd" for the rest of the game. They are not allowed to call you by your nickname, first name, or last name.

If a player messes up and calls you by another name, they must take 2 drinks.

707

WORKOUT KARMA

The cup decides what workout. You must do it 10 times.

1 = Sit-ups
2 = Pushups
3 = Jumping Jacks
4 = Sit-ups
5 = Pushups
6 = Jumping Jacks If you refuse, the number the cup landed on is how many drinks you must take

703

ORGASMIC KARMA

Pretend you're having an orgasmic moment and start acting it out.

If you refuse, the number the cup landed on decides how many drinks you must take.

1 or 2 = 3 Drinks
3 or 4 = 4 Drinks
5 or 6 = 5 Drinks

708

SPANKING KARMA

Let someone in the room spank you three times. You can either stand in front of them or bend over their knees.

If you refuse, the number the cup landed on decides how many drinks you must take.

1 or 2 = 3 Drinks
3 or 4 = 4 Drinks
5 or 6 = 5 Drinks

704

Skunk Stump KARMA

Read three times fast.

A skunk sat on a stump and thunk the stump stunk, but the stump thunk the skunk stunk.

If you misread this, the number the cup landed on is how many drinks you must take.

709

PROPOSAL KARMA

Give your best (PRETEND) marriage proposal to someone in this room.

If the other person says yes, your turn is over. If the other person says no, the number the cup landed on decides how many drinks you must take.

1 or 2 = 3 Drinks
3 or 4 = 4 Drinks
5 or 6 = 5 Drinks

705

Thumb master Karma

You are the Thumb Master. Later in the game, slyly place your thumb on the table or countertop. As the other players notice this, they must place their thumb discreetly on the table or countertop. The last player to put their thumb on the table or countertop has to take two drinks.

However, they may immediately take their revenge, since this player now becomes the next Thumb Master, this continues until the end of the game.

710 forehead Karma

The player of your choice, writes whatever they want on your forehead with a marker or pen.

If you refuse, the number the cup landed on decides how many drinks you must take.

1 or 2 = 3 Drinks
3 or 4 = 4 Drinks
5 or 6 = 5 Drinks

FIG. 9A

DOG KARMA

The player of your choice throws one of their shoes and you must fetch it like a dog.

If you refuse, the number the cup landed on decides how many drinks you must take.

1 or 2 = 3 Drinks
3 or 4 = 4 Drinks
5 or 6 = 5 Drinks

711

712 spinning KARMA

Spin 7 times fast in a circle.

If you refuse, the number the cup landed on is how many drinks you must take

713 shirt KARMA

Take your shirt off for the rest of the game.

If you refuse, the number the cup landed on is how many drinks you must take.

714 bear bug karma

Read three times fast.

The big black bug bit the big black bear but the big black bear bit the big black bug back!

If you misread this, the number the cup landed on is how many drinks you must take.

715 sex Karma

Is there anyone in the room you would like to have sex with? If yes, tell us who it is.

If you said no one, the number the cup landed on is how many drinks you must take. Drink up! (maybe this will help change your mind)

top 3 KARMA

Tell everyone the top 3 reasons why you are the best person to marry or date.

If can't give three reasons, the number the cup landed on is how many drinks you must take

716

BARTENDER KARMA

You are the official Bartender.

Anytime another player needs a drink, get them a drink for the rest of the game.

717 robert lee redems KARMA

GAME INVENTOR

Pick another player to finish their drink

718

Naked Karma

Is there anyone in the room you would like to see naked? If yes, tell us who it is.

If you said no one, the number the cup landed on is how many drinks you must take. Drink up! (maybe this will help change your mind)

719

Wave master Karma

You are the Wave Master. Later in the game, throw both arms up in the air. As the other players notice they also throw their arms up in the air. The last player to throw their arms up in the air must take two drinks.

However, they may immediately take their revenge. Since this player now becomes the next Wave Master, this continues until the end of the game

720

FIG. 9B

| | |
|---|---|
| 721<br>great Karma<br><br>The number the cup landed on is how many drinks all the other players must take.<br><br>Also, reverse the order in which players take their turns. | 726<br>high Karma<br><br>High five everyone in the room.<br><br>Also, reverse the order in which players take their turns. |
| 722<br>peer pressure Karma<br><br>Ask each player one at a time if you should take 0,1, or 2 drinks. Do as each player tells you. | Truth Karma<br>Another player gets to ask you a question; the cup decides who.<br><br>1 or 2 = Player before you<br>3 or 4 = Player after you<br>5 or 6 = Player of your choice<br><br>If you refuse, the number the cup landed on is how many drinks you must take. 727 |
| dare Karma<br>Another player gets to give you a dare; the cup decides who.<br><br>1 or 2 = Player before you<br>3 or 4 = Player after you<br>5 or 6 = Player of your choice<br><br>If you refuse, the number the cup landed on is how many drinks you must take. 723 | wild Karma 728<br><br>If the cup landed on<br><br>1 or 2 = Take two drinks<br>3 = Finish your drink<br>4 or 5 = Give away two drinks<br>6 = No one drinks |
| choice Karma<br>The player of your choice tells you to do one of the following. (Their choice)<br><br>Take 1 drink<br>Take 2 drinks<br>Take 3 drinks<br>Finish your drink<br>Take a shot 724 | 729<br>Give Karma<br><br>The number the cup landed on is how many drinks you give away. |
| 725<br>drink Karma<br><br>The number the cup landed on is how many drinks you must take.<br><br>If the cup landed on 6, you take 0 drinks. | 730<br>shot Karma<br><br>You take a shot.<br><br>If you refuse, the number the cup landed on is how many drinks you must take. |

FIG. 9C

| | |
|---|---|
| Death Karma<br>Stand up, then fall down and give your best death performance.<br><br>If you refuse, the number the cup landed on decides how many drinks you must take.<br>1 or 2 = 3 Drinks<br>3 or 4 = 4 Drinks<br>5 or 6 = 5 Drinks<br>731 | finish Karma<br>The number the cup landed on, decides who finishes their drink<br><br>1 or 2 = You<br>3 or 4 = Player before you<br>5 or 6 = Player after you<br>736 |
| Military Karma<br><br>You must say "Sir" at the beginning and the end when you speak for the rest of the game.<br><br>If you forget, you must take 2 drinks<br>732 | 737<br>leap frog Karma<br><br>Pick another player and leap frog over each other 2 times each.<br><br>If you or the other player refuse, the number the cup landed on is how many drinks you both must take |
| 733<br>bottom up Karma<br><br>You must finish your drink.<br><br>Also, reverse the order in which players take their turns. | thumb war Karma<br>Pick another player for "Thumb War"<br><br>The number the cup landed on decides how many drinks the loser takes.<br><br>1 or 2 = 3 Drinks<br>3 or 4 = 4 Drinks<br>5 or 6 = 5 Drinks<br>738 |
| 734<br>wonder twin powers Karma<br><br>Choose someone to drink with you for the rest of the game.<br><br>(They drink when you drink and vice versa) | 739<br>Battle of the sexes Karma<br><br>The number the cup landed on is how many drinks everyone of the opposite gender must take. |
| Bipolar Karma<br>You must insult the next player, then compliment the player before you.<br><br>If you refuse, the number the cup landed on decides how many drinks you must take.<br>1 or 2 = 3 Drinks<br>3 or 4 = 4 Drinks<br>5 or 6 = 5 Drinks<br>735 | 740<br>Police Karma<br>Pick another player to be a Police Officer, close your eyes, tilt your head back slightly and touch your nose with your index finger. This is repeated three times alternately with each hand, for a total of 6 attempts.<br><br>If the Officer say's you passed take 0 drinks. If the Officer say's you failed take 3 drinks. If you refuse the test take 5 drinks. |

FIG. 9D

| | |
|---|---|
| 741<br>dare Karma<br>Another player gets to give you a dare; the cup decides who.<br>1 or 2 = Player before you<br>3 or 4 = Player after you<br>5 or 6 = Player of your choice<br>If you refuse, the number the cup landed on is how many drinks you must take. | 746<br>Pacifier Karma<br>When a player says<br>"Where's my pacifier"<br>You must suck your thumb every time another player says this frase, until the end of the game.<br>If you refuse, you must take 2 drinks. |
| 742<br>social Karma<br>Everyone takes one drink.<br>Also, reverse the order in which players take their turns | 747<br>Barking Karma<br>Every time the cup sinks, bark three times like a dog for the rest of the game.<br>If you forget, take two drinks. |
| 743<br>Rock Paper Scissors Karma<br>Pick another player for "Rock Paper Scissors" Best of 3 games wins<br>The number the cup landed on is how many drinks the loser must take | 748<br>Staring karma<br>Pick another player for a "Staring Contest" and first player to blink loses.<br>The number the cup landed on decides how many drinks the loser must take.<br>1 or 2 = 3 Drinks<br>3 or 4 = 4 Drinks<br>5 or 6 = 5 Drinks |
| 744<br>wild Karma<br>If the cup landed on<br>1 or 2 = Take two drinks<br>3 = Finish your drink<br>4 or 5 = Give away two drinks<br>6 = No one drinks | 749<br>picture Karma<br>Post a Selfie or a group picture with one of the following hashtags.<br>Good times #Downwardkarma<br>Everyone needs a drink #Downwardkarma<br>Best game ever #Downwardkarma<br>Life is Good #Downwardkarma #Downwardkarma<br>If you refuse the number the cup landed on is how many drinks you must take. |
| 745<br>Non-Dominant Karma<br>Use your non-dominant hand only when pouring water into the cup for the rest of the game.<br>If you forget, take two drinks. | 750<br>Nickname Karma<br>Nickname another player; all players must call this player by the nickname for the rest of the game.<br>If a player messes up and calls the player by another name, they must take 2 drinks. |

FIG. 9E

T-rex Karma

You must do T-rex arms (elbows touching your sides) when pouring water in the cup for the rest of the game.

If you forget, take 2 drinks.

751

756

Silent Karma

Nobody can talk to you for the rest of the game. You can try to make people talk to you.

If another player talks to you, they must take 2 drinks.

Truth Karma

Another player gets to ask you a question; the cup decides who.

1 or 2 = Player before you 3 or 4 = Player after you 5 or 6 = Player of your choice

752

If you refuse, the number the cup landed on is how many drinks you must take.

757 give shot Karma

Pick another player to take a shot.

If the player refuses, the number the cup landed on is how many drinks they must take.

FIG. 9F

GAME APPARATUS WITH MATCHED OUTER AND INNER VESSELS AND METHOD OF PLAYING

CROSS-REFERENCE TO RELATED APPLICATIONS

This application claims priority to U.S. provisional patent application No. 62/293,401 filed Feb. 10, 2016, and U.S. provisional application No. 62/222,380, filed Sep. 23, 2015, the contents of which are incorporated herein by reference in their entirety.

BACKGROUND

Games serve many purposes. They can be used to pass the time and are a form of amusement and entertainment. They provide escape, a way to have fun, socialize or engage in friendly competition with family and friends thereby promoting healthy social interactions.

Games can also be a valuable learning tool. Some games are interactive and require the player to think, experiment and adapt to changing conditions. These games can be useful for improving logic and reasoning skills, spatial reasoning, critical thinking, and reading skills. They can provide the young player with opportunities to engage in positive social interactions and develop useful social skills.

SUMMARY

The invention provides a game apparatus and method of playing the game that promotes critical thinking, exploration of the principles of buoyancy and fluid mechanics while engaging in an enjoyable social activity. The invention provides an apparatus having a pair of matched inner and outer vessels effective to receive and hold a fluid such as water, a set of cards with text describing actions to be performed by the players that is content-matched to elements on the outer vessel, and a method for playing a game using the pair of matched inner and outer vessels and cards.

In one aspect, the invention provides an apparatus for playing a game that includes a pair of matched vessels: an inner vessel and an outer vessel. Each of the inner and outer vessels includes a bottom with a circular edge and lateral wall adjoining the circular edge that extends upward to form a vessel body with a hollow interior and a circular open top. The matched vessels are configured so the inner vessel is substantially upright and rotatable on its axis when placed at the bottom of the hollow interior of the outer vessel. The outer vessel includes a plurality of outcome elements on its surface in a circular pattern concentric with the lateral wall of the outer vessel; and the inner vessel includes an outcome indicator on its surface that aligns with an outcome element on the outer vessel when the inner vessel is at the bottom of the hollow interior of the outer vessel.

In some embodiments of an apparatus of the invention, the outer vessel has a height between about one and a half times to about eight times the height of the inner vessel and a hollow interior width that is greater than the width of the inner vessel, the hollow interior width and inner vessel width corresponding to respective widths at the same distance from the bottom of the hollow interior of the outer vessel, the inner vessel width being determined when the inner vessel is placed at the bottom of the hollow interior of the outer vessel, the hollow interior width of the outer vessel being no more than 50% greater than the width of the inner vessel.

In some embodiments of an apparatus of the invention, the lateral wall of the outer vessel body extends upward from the circular edge bottom at an outward angle of about 1° relative to the axis of symmetry of the outer vessel body to form a frusto-conical body having a bottom that is narrower than its top.

In some embodiments, the outer vessel has a toroidal base encircling the lower portion of the vessel body. In some embodiments, the plurality of outcome elements is disposed on the surface of the toroidal base.

In some embodiments, the outer vessel has a plurality of boundary mark, each boundary mark being disposed between adjacent outcome elements on the toroidal base surface to segment the toroidal base into portions, each corresponding to an outcome element.

In some embodiments of an apparatus of the invention, the plurality of outcome elements is disposed on the lateral wall of the outer vessel body.

In some embodiments of an apparatus of the invention, the inner vessel has a plurality of congruent fins, each having a flat helical segment with an inner longitudinal edge adjoining the exterior of the lateral surface of the inner vessel body, and a free outer longitudinal edge, each fin comprising a curvature between about 20° to about 60° relative to the open-top edge of the inner vessel body. In some embodiments, the fins have a width that is about a $\frac{1}{4}^{th}$ the width of the inner vessel body.

In some embodiments of an apparatus of the invention, the inner vessel has four horizontally, non-overlapping fins.

In some embodiments, the inner vessel further includes an outer cylindrical ring adjoining an upper portion of each of the fins, the outer cylindrical body encircling at least a portion of inner vessel body thereby forming the widest portion of the inner vessel. In some embodiments, the outer cylindrical ring is elevated relative to the inner vessel body. In some embodiments, the outer cylindrical ring has a height that is about half to about one and a half the height of the inner vessel body.

In some embodiments, the outer vessel has a bottom with a circular edge of about 4 inches wide and a circular open top of about 4.5 inches wide. In some embodiments, the matched inner vessel has an inner vessel body; four congruent, helical fins having an inner longitudinal edge that adjoins the lateral surface of the inner vessel body and a free outer longitudinal edge; and an outer cylindrical ring adjoining an upper portion of each fins to encircle at least a portion of the inner vessel body; wherein (a) the inner vessel body has a width about four times the width of one helical fin; (b) each fin has a width between the inner and outer longitudinal edges of about ½ an inch; and (c) the outer cylindrical ring has a width of about 3.5 inches wide.

In some embodiments of an apparatus of the invention, the outer vessel has a first alignment means centrally disposed on the interior surface of the bottom of the outer vessel and the inner vessel has a second alignment means centrally disposed on the exterior surface of the bottom of the inner vessel, the first and second alignment means having complementary surface contours that combine to limit rotation of the inner vessel when the inner vessel is at the bottom interior of the outer vessel.

In another aspect, the invention provides a plurality of playing cards, at least one of which includes an outcome element of claim 1.

In another aspect, the invention provides a game set having a game apparatus with matched inner and outer vessels and a plurality of playing cards, at least one of which includes at least one outcome element on the outer vessel of the game apparatus.

In another aspect, the invention provides a method for two or more players to play a game using the apparatus of the invention that involves the steps of: (a) adding a select level of fluid to the hollow interior of the outer vessel; (b) placing the inner vessel in the fluid in the outer vessel to allow the inner vessel to float; and (c) requiring each player in turn to add at least a drop of fluid to the inner vessel body until a player causes the inner vessel to sink to the bottom of the outer vessel, wherein the player who causes the inner vessel to sink loses.

In some embodiments, the method further involves requiring the player who causes the inner vessel to sink to the bottom to draw a card from a plurality of cards, at least one of which includes at least one outcome element on the outer vessel of the game apparatus, and performing an act according to the textual description on the drawn card.

In some embodiments, the method further involves: (a) establishing an act associated with each outcome element on the outer vessel; (b) determining which outcome element on the outer vessel is aligned with the outcome indicator on the inner vessel when the inner vessel is at the bottom of the outer vessel; and (c) requiring the player who causes the inner vessel to sink to the bottom to preform the act associated with the outcome element determined in step (b).

Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

Other features and advantages of the invention will be apparent from the following detailed description and from the claims.

DESCRIPTION OF THE DRAWINGS

FIGS. 1A-1G are schematic drawings providing various views of a two vessel game apparatus of the invention including: a top perspective view of game apparatus 10 that includes an outer vessel 20 and inner vessel 70 (1A); a top perspective view of outer vessel 20 (1B); a top perspective view of vessel 70 (1C); a top view of vessel 70 (1D); a bottom perspective view of vessel 70 (1E); a vertical cross-sectional view of vessel 70 (1F); a side view of vessel 70 (1G); a vertical cross-sectional view of outer vessel 20 (111), a horizontal cross-sectional view of outer vessel 20 through base 30 along line 1I-1I (1I), and a vertical cross-sectional view of inner vessel 70 in an upright position at the bottom of the hollow interior of outer vessel 20 (1J).

FIGS. 8A-8B is a flowchart summarizing another method of playing a game of the invention (8A) and a score table that can be used in a game of the invention.

FIGS. 9A-9F illustrate karma cards that can be used in a game of the invention.

DETAILED DESCRIPTION

Figure 1E:
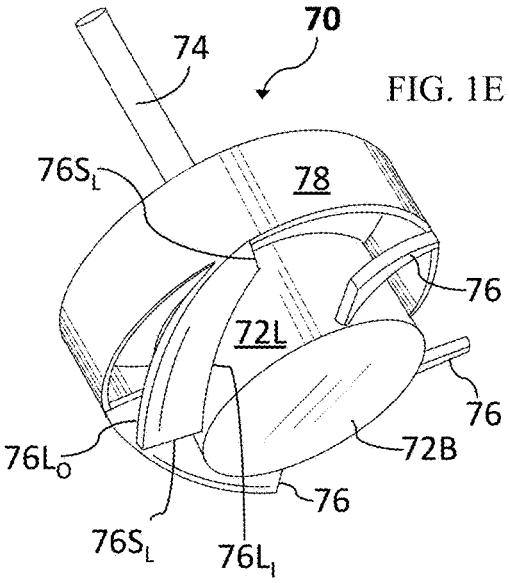
Figure 1F:
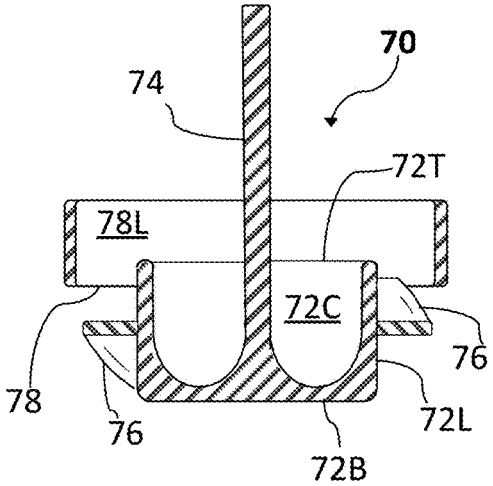

The invention provides a game apparatus with matched outer and inner vessels for playing a variety of games, as well as game rules that can be used. Exemplary embodiments of a game apparatus having matched outer and inner vessels and rules for playing a game using the pair of matched outer and inner vessels of the invention are illustrated in the Figures. A game apparatus of the invention includes a pair of matched vessels, an inner vessel and an outer vessel, each having a bottom with a circular edge and lateral wall adjoining the circular edge that extends upward to form a vessel body with a hollow interior and a circular open top. The matched vessels are configured so the inner vessel is substantially upright and rotatable on its axis when placed at the bottom of the hollow interior of the outer vessel. The outer vessel includes a plurality of outcome elements on its surface in a circular pattern concentric with the lateral wall of the outer vessel; and the inner vessel includes an outcome indicator on its exterior surface that aligns with an outcome element on the outer vessel when the inner vessel is at the bottom of the hollow interior of the outer vessel.

A game apparatus of the invention includes a pair of dimension-matched outer and inner vessels, the vessels being configured to enable the inner vessel to fit substantially upright within the hollow interior of the outer vessel so as to be rotatable on its axis. Both vessels have a body with a hollow interior effective to receive and hold a fluid, for example, a drink such as water or beer. The outer and inner vessels each include a vessel body having a bottom with a circular edge from which a lateral wall extends upward to form a hollow interior with a circular open top.

The outer vessel is larger than the matching inner vessel so as to fully contain the inner vessel in its hollow interior. The outer vessel can have a cylindrical body having a hollow interior with a circular cross-section of a constant radius. The outer vessel can have a frusto-conical body having a hollow interior with a circular cross-section of decreasing diameter toward the bottom of the vessel.

The outer vessel or the hollow interior of the outer vessel has a height between about 1.5 to about 8 times the height of the inner vessel body. For example, the height of the outer vessel or the height of the hollow interior of the outer vessel can be about 2, about 3, about 4, about 5, about 6 or about 7 times the height of the inner vessel body without the post (discussed below). The term "about" in reference to a numeric value means within 10% of the specified value. FIG. 1J provides a comparison of the height of an inner vessel of the invention with the height of the hollow interior of a matched outer vessel of the invention. FIG. 1J shows that the height of outer vessel 20 or its hollow interior, represented by $O_h$, is just over 3 times the height of inner vessel 70, represented by $I_h$. In some embodiments, the outer vessel can be configured to have a hollow interior capacity that can hold a volume of fluid sufficient to allow the inner vessel and at least a portion of the post (discussed below) to be fully submerged in the fluid when the matched inner vessel sinks to the bottom of the outer vessel containing the fluid. The inner vessel is "fully submerged" when all but a portion of the central post (discussed below) is submerged or beneath the fluid.

In general, the hollow interior of an outer vessel of the invention has a cross-sectional diameter just wider than the width of the matched inner vessel at the corresponding distance from the bottom of the hollow interior so as to contain the inner vessel in a substantially upright position while providing sufficient clearance for the inner vessel to be rotatable on its axis as illustrated in FIG. 1J. The outer and inner vessels are matched in that the width of the hollow interior of the outer vessel at any distance from the bottom of the hollow interior, is greater than the width of the inner vessel at the corresponding distance from the bottom of the hollow interior to enable the inner vessel to fit within the hollow interior of the outer vessel, while being no more than 50% greater than the width of the inner vessel to enabling the inner vessel adopt a substantially upright position and rotatable on its axis when at the bottom of the hollow interior as shown in FIG. 1J. For example, the width of the hollow interior of outer vessel 20 at a first position, represented by $W1_c$ in FIG. 1J, is greater than the width of matched inner vessel 70 at the corresponding position, represented by $W1_i$ in FIG. 1J. Similarly, the width of the hollow interior of outer vessel 20 at a second position, represented by $W2_c$ in FIG. 1J, is greater than the width of matched inner vessel 70 at the corresponding position, represented by $W2_i$ in FIG. 1J. Thus, the inner vessel has a vertical profile that follows the interior surface of lateral wall 70L of the outer vessel with which it is matched, the lateral surface of the hollow interior complementing the vertical profile of the matched inner vessel.

Thus, the width of the hollow interior of the outer vessel and the width of the inner vessel being compared herein correspond to respective widths at substantially similar distance from the bottom of the hollow interior of the outer vessel, the width of the inner vessel being determined when the inner vessel is at the bottom of the hollow interior of the outer vessel.

In some embodiments, the width of the hollow interior of the outer vessel is no more than 10% greater, or no more than 5% greater, than the width of the inner vessel at substantially similar positions above the bottom of the hollow interior of the outer vessel, the width of the inner vessel being determined when the inner vessel is at the bottom of the hollow interior. The width of the hollow interior of the outer vessel can be, for example, about 28%, about 26%, about 24%, about 22%, about 20%, about 18%, about 16%, about 14%, about 12%, about 10%, about 8%, about 6%, about 4%, about 2%, or about 1% greater than the width of the inner vessel determined as discussed above.

The difference between the width of the hollow interior of the outer vessel and the width of the inner vessel provides clearance between the lateral walls of the outer and inner vessels contained within to allow the inner vessel to rotate on its axis.

In some embodiments, the lower portion of the hollow interior of the outer vessel body can be narrower than the upper portion of the hollow interior of the outer vessel body. In these embodiments, the difference between the width of the narrower portion of the hollow interior and the width of the inner vessel is also sufficient to provide clearance to allow the inner vessel to be rotatable on its axis, while enabling the inner vessel to adopt a substantially upright position as discussed above.

An inner vessel is substantially upright and rotatable in the outer vessel when the vertical axis of the inner vessel is within about 23° of the vertical axis of the outer vessel, for example, about 22°, about 21°, about 20°, about 19°, about 18°, about 17°, about 16°, about 15°, about 14°, about 13°, about 12°, about 10°, about 9°, about 8°, about 7°, about 6°, about 5°, about 4°, about 3°, about 2°, about 1° or about 0° degrees relative to the vertical axis of the outer vessel. As used herein the term "axis or "vertical axis" refers to the axis of rotation or axis of symmetry of the cylindrical or frusto-conical vessel body.

And inner vessel can have any convenient size or shape so long as it fits substantially upright within the hollow interior of the matched outer vessel and has substantial rotational symmetry. An inner vessel of the invention has a vessel body formed by a bottom with a circular edge and lateral wall extending upward from the circular edge bottom to a circular top. The lateral wall of the inner vessel body can extend directly upward to form a cylindrical vessel body (e.g., FIGS. 1E, 2C, 4C) or extend upward at an outward angle to form a vessel with a frusto-conical body in which the top is wider than the bottom (e.g. FIG. 3C). The inner vessel body, whether cylindrical or frusto-conical, can optionally include a tapered bottom (e.g., FIGS. 3E, 4C, 4E) for added stability.

In some embodiments, the matched inner vessel can include a plurality of substantially congruent, helical segments or fins attached to the exterior lateral surface of the vessel body to facilitate rotation of the inner vessel about its axis when the inner vessel, placed within a fluid-filled matched outer vessel, is filled to capacity and sinks to the bottom of the fluid-filled outer vessel. In these embodiments, the inner vessel can have, for example and without limitation, 2, 3, 4, 5, 6, or more than 6 fins disposed substantially evenly on the exterior lateral surface of the inner vessel body. The helical fins have a generally flat structure with a first longitudinal edge, i.e., an inner edge, which adjoins the exterior lateral surface of the inner vessel body and a free, second longitudinal edge, i.e. a free outer edge. The helical fins can be sized and angled to be horizontally overlapping (fins 176 in FIG. 2C) or horizontally non-overlapping (fins 76 in FIG. 1E) based on the size of the inner vessel body, for example, based on its circumference and the height of its lateral wall. The helix angle of the fins can have any value greater than 0° and less than 90°, for example, about 10°, about 15°, about 20°, about 25°, about 30°, about 35°, about 40°, about 45°, about 50°, about 55°, about 60°, about 65°, about 70°, about 75°, about 80°, or about 85° relative to the post or axis of rotation of the inner vessel body.

The matched inner vessel can, optionally, include an outer cylindrical ring for added stability (FIG. 1C, 1E). Where present, the outer cylindrical ring encircles the fins and inner vessel body, thereby forming the widest portion of the inner vessel. Where present, the outer ring can be elevated or leveled with the fins and inner vessel body, and can have a lateral surface that is about ½ to about 1¼ times the height of the lateral wall of the inner vessel body.

The inner vessel also includes a central post to facilitate retrieval from the outer vessel. See for example, FIG. 1C, post 74. The central post extends directly upward from the center of the interior bottom of the inner vessel body and can have a height at least 1 and ½ times to about 5 times the height of the inner vessel. The central post has an axis of symmetry or axis of rotation coinciding with the axis of symmetry or axis of rotation of the inner vessel body.

The pair of matched outer and inner vessels of the invention also includes position-matched outcome elements and outcome indicator.

An outcome element can be a symbol, number, lower or upper case Arabic or non-Arabic alphabet, icon, regular or irregular shape, pictogram, image, or any combination thereof disposed on the surface of an outer vessel of the invention in a circular pattern concentric with the lateral wall of the outer vessel body. An outer vessel of the invention typically includes a plurality of outcome elements. In some embodiments, the outer vessel includes a plurality of boundary marks separating the outer vessel into regions or portions that are each associated with an outcome element of the plurality of outcome elements. Each boundary mark separates adjacent outcome elements so as to mark the boundary of a portion of base associated with a particular outcome element. A boundary mark can be any mark, symbol, indentation or depression, ridge, number, lower or upper case Arabic or non-Arabic alphabet, icon, shape, pictogram, image of any size, shape or color that is different from the outcome elements on the outer vessel thus allowing it to demarcate the boundaries of a region or portion of an outer vessel that is associated with a particular outcome element on the outer vessel. Examples of outcome element and boundary marks include element 32 and mark 34 illustrated in FIG. 1B.

An outcome indicator can be any mark, symbol, indentation or depression, ridge, number, lower or upper case Arabic or non-Arabic alphabet, icon, shape, pictogram, image of any size, shape or color that is visible on the inner vessel and is effective to indicate the rotational orientation or position of the inner vessel relative to the outer vessel. An outcome indicator can be disposed on the surface of any component of the inner vessel in a position that allows the outcome indicator to be visible and position matched with an outcome element on the outer vessel. In a pair of matched outer and inner vessels, the outcome indicator on the inner vessel is position matched with the plurality of outcome elements on the outer vessel when the outcome indicator on the inner vessel can point to, or align or associate with, an outcome element on the outer vessel when the inner vessel is substantially upright at the bottom of the hollow interior of the outer vessel. Where the outcome indicator is elongated, for example, a line, an elongated depression or ridge, or an arrow, the outcome indicator can be parallel to the vertical axis of the inner vessel body. Where the outcome indicator is a direction-indicating shape such as an arrow, the outcome indicator is positioned to allow it to point to an outcome element on the outer vessel. The outcome indicator can extend in any direction, for example, upward, downward or obliquely, so long as it is position matched with the plurality of outcome elements on the outer vessel to enable it to point to, aligns with, or otherwise associates with a particular outcome element or a region or portion of the outer vessel corresponding to a particular outcome element when the inner vessel sinks to the bottom of the hollow interior of the outer vessel. An example of an outcome indicator is element 80 illustrated in FIG. 1C.

The pair of matched outer and inner vessels also includes complementary alignment means on surfaces of the inner and outer vessels that are opposing when the inner vessel is at the bottom of the hollow interior of the outer vessel. The alignment means on the inner vessel is on the underside of the inner vessel situated about the center of the bottom's exterior surface. The complementary alignment means on the outer vessel is at the bottom of the hollow interior situated about the center of the interior bottom surface of the outer vessel. The alignment means on the outer and inner vessels include complementary protrusions of a regular or irregular pattern that engage when the inner vessel is at the bottom of the hollow interior of the outer vessel to enable the inner vessel to maintain a particular rotational orientation or position relative to the outer vessel.

In some embodiments, the outer vessel can include a base to support the outer vessel body and/or receive fluid spillage during game play. The base can be a plate with rim on which the outer vessel body is disposed. The base can be a toroidal ring encircling a portion of the outer vessel body, for example, encircling the bottom portion of the outer vessel body to add stability. The base can be constructed of the same or different materials than the transparent outer vessel body and can be constructed as a separate component separable from the outer vessel body or constructed as an inseparable integral component of the outer vessel body.

In some embodiments, the outer vessel can include a fluid level indicator in the form of a letter, number, shape, symbol, color, icon, image, line, depression, ridge, or any combination thereof to indicate a desired level of fill, for example, a level of fluid that the outer vessel can hold without overflowing when the matched inner vessel filled to capacity is submerged in the fluid-filled outer vessel.

The inner and outer vessel can be constructed of any material known to those skilled in the art. The transparent outer vessel body can be made of any transparent material known to those skilled in the art including, for example, and without limitation, glass or transparent plastics such as acrylic (polymethlamethacrylate), butyrate (cellulose acetate butyrate), polycarbonate, glycol modified polyethylene terephthalate (PETG) or any combination thereof. The inner vessel can be made of materials that allow it to float in water when empty. Examples include, without limitation, a natural or synthetic resin, plastic, polymer or any combination thereof. The inner vessel material can have a density at, below, or above about 1 g/cm$^3$, for example, about 0.5 g/cm$^3$ to about 3 g/cm$^3$. The density of the inner vessel can be about 0.75 g/cm$^3$, about 0.8 g/cm$^3$, about 0.85 g/cm$^3$, about 0.9 g/cm$^3$, about 0.95 g/cm$^3$, about 1 g/cm$^3$, about 1.05 g/cm$^3$, about 1.10 g/cm$^3$, about 1.15 g/cm$^3$, about 1.2 g/cm$^3$, about 1.25 g/cm$^3$, about 1.3 g/cm$^3$, about 1.35 g/cm$^3$, about 1.4 g/cm$^3$, about 1.45 g/cm$^3$, about 1.5 g/cm$^3$, about 1.75 g/cm$^3$, about 2 g/cm$^3$, about 2.25 g/cm$^3$, about 2.5 g/cm$^3$, about 2.75 g/cm$^3$ or about 3 g/cm$^3$. Non-limiting examples of materials that can be used in a vessel of the invention, or optionally, the base for the outer vessel include one or more synthetic or non-synthetic materials including, without limitation, metals, elastomers as well as thermoplastics or thermosetting polymers. Specific examples include, without limitation, thermoplastics such as polyester resin, acetal resin, nylon resin and other engineering-type thermoplastics such as acetals. Additional examples include: ultra-high-molecular-weight polyethylene (UHMWPE), Nylon 6, Nylon 6-6, polytetrafluoroethylene (PTFE/Teflon), acrylonitrile butadiene styrene (ABS), polycarbonates (PC), polyamides (PA), polybutylene terephthalate (PBT), polyethylene terephthalate (PET), polyphenylene oxide (PPO), polysulphone (PSU), polyetherketone (PEK), polyetheretherketone (PEEK), polyimides, polyphenylene sulfide (PPS), polyoxymethylene plastic (POM/Acetal), high-density polyethylene, polyvinyl chloride, low-density polyethylene, polypropylene, polyamides, acrylonitrile butadiene styrene, polycarbonate/acrylonitrile butadiene styrene, and polyetheretherketone.

In some embodiments, the inner vessel can be constructed with a weight of about 25 grams to about 700 grams. For example, the inner vessel can be about 125 grams, about 150 grams, about 175 grams, about 200 grams, about 250 grams, or about 275 grams. The weight of the inner vessel can be evenly distributed throughout the body of the inner vessel, or alternatively, the inner vessel can be constructed with a solid bottom so as to be bottom heavy (FIGS. 3C, 4C).

The inner and outer vessel can be constructed using methods known to those skilled in the art including injection molding. The components of the outer and inner vessel can be constructed separately and then assembled and/or attached using known means including, for example, using an adhesive or a snapfit mechanism. Alternatively, one or more components can be constructed as an integral part of the vessel body. For example, the inner vessel body, post, fins, and outer ring can be integrally formed using an injection molding process.

The invention also provides karma cards 701-757 (FIGS. 9A-9F) that can be used with a game apparatus of the invention. Karma cards 701-757 are content matched with a game apparatus of the invention in that one or more of karma cards 701-757 include one or more outcome elements on the outer vessel of the matched game apparatus. Where a karma card includes one or more outcome elements found on the outer vessel, e.g., karma cards 703, 706-710, the karma card also stipulates one or more actions to be performed for one or more outcome elements on the karma card.

In another aspect, the invention provides methods for playing a game using the pair of matched vessels. Generally, the outer vessel is filled with a desired amount of fluid. The inner vessel is then placed into the fluid-filled outer vessel, allowing it to float freely in the fluid. Two or more players take turns adding at least a drop of a fluid, for example, water or beer, to the inner vessel until a player causes the inner vessel to sink. The player who causes the inner vessel to sink loses. In some embodiments of a game of the invention, the player who causes the inner vessel to sink is required to draw a karma card and perform the actions described on the drawn card. In some embodiments, players can agree to an action for each outcome element on the outer vessel prior to the start of game play, and the player who causes the inner cup to sink is required to perform the action established for a particular outcome element to which the outcome indicator points to or aligns with.

Specific embodiments of the invention are described in the following examples, which do not limit the scope of the invention described in the claims.

EXAMPLES

Example 1—Game Apparatus 10

An embodiment of a game apparatus of the invention is illustrated in FIG. 1A. Game apparatus 10 includes outer vessel 20 (FIG. 1B) and inner vessel 70 (FIG. 1C).

Outer vessel 20 includes transparent, open-top vessel body 22 and toroidal base 30 (FIGS. 1B, 1H). Transparent vessel body 22 includes lateral portion 22L extending upward at an outward angle of about 1° from the circular edge of bottom 22B to form a frusto-conical body having open top 22T and hollow interior 22C through which it receives and holds a fluid. The outward angle of lateral wall 22L can be determined relative to the axis of symmetry of outer vessel body 22. As such, open top 22T has a greater diameter than bottom 22B resulting in a trapezoidal vertical cross-section with a 2° bottom taper, for example, as shown in FIG. 1H (vertical cross-section of body 22 includes a structure resembling an isosceles trapezoid). In another embodiment, the transparent, open-top body of outer vessel 20 can have a cylindrical structure form by a lateral portion that extends directly upward from the circular edge of the bottom resulting in a cylindrical vertical cross-section.

Outer vessel 20 also includes toroidal base 30 having a structure resembling a torus (FIGS. 1A, 1B) with a trapezoidal vertical cross-section as shown in FIG. 1H. In other embodiments, toroidal base 30 can have the structure of a torus with a vertical cross-section of any shape including, for example, a rectangular, square or circular cross-section. Irrespective of cross-sectional shape, toroidal base 30 is configured with a center opening at least wider than the width of open-top body 22 where their surfaces contact or where their surfaces come in closest proximity to enable open-top body 22 to be placed in center opening of toroidal base 30 as shown in FIGS. 1A-1B & 1H-1I.

Toroidal base 30 includes, on its surface, a plurality of outcome element 32—the numbers 1, 2, 3, 4, 5 and 6—uniformly spaced in a circular pattern generally concentric with outer vessel body 22 (FIGS. 1A, 1B). Toroidal base 30 also includes six boundary marks 34 that function to separate base 30 into six portions, each portion being associated with a particular outcome element 32 (FIGS. 1A, 1B). Boundary mark 34, which occurs between each of the numbers 1, 2, 3, 4, 5 and 6, separates base 30 into six portions, each portion being associated with one number of the numbers 1, 2, 3, 4, 5 and 6. For example, the two boundary marks 34 on each side the number "4" on base 30 (FIG. 1B) act to identify the portion of base 30 associated with the number "4".

Inner vessel 70 (FIG. 1C) is dimensioned to fit inside hollow interior 22C of outer vessel 20 so as to be substantially upright and rotatable on its axis of symmetry when placed into outer vessel 20 containing a fluid (FIG. 1B). Inner vessel 70 includes: inner vessel body 72, post 74 extending upwardly from center of inner vessel body 72, outer cylindrical ring 78, four horizontally, non-overlapping fins 76 that connect inner vessel body 72 and outer cylindrical ring 78, and outcome indicator 80 on outer cylindrical ring 78 (FIG. 1C-1G). Inner vessel body 72 includes lateral wall 72L extending upward from the circular edge of bottom 72L to open top 72T forming hollow interior 72C. As such, inner vessel body 72 is effective to receive and hold a fluid. Post 74 extends upwardly from center bottom 72B and allows inner vessel 70 to be conveniently lifted out of outer vessel 20.

The four horizontally, non-overlapping fins 76 of inner vessel 70 are flat, helical segments joining inner vessel body 72 and outer cylindrical ring 78. Each fin 76 has two longitudinal edges, inner edge 76$L_I$ and an outer edge 76$L_O$, and two lateral edges, upper edge 76$S_U$ and lower edge 76$S_U$. Inner edge 76$L_I$ adjoins the exterior side of lateral wall 72L, and outer edge 76$L_O$, is a primarily free edge having an upper portion that adjoins lateral wall 78L of outer cylindrical ring 78 as illustrated in FIG. 1D (see also FIGS. 1C, 1E-1G).

Fins 76 are substantially congruent, each having a width about ¼ the width of inner vessel body 72. For example, an inner vessel body about 2 inches wide can be configured with four congruent fins of about 0.5 inches wide.

Figure 1G:
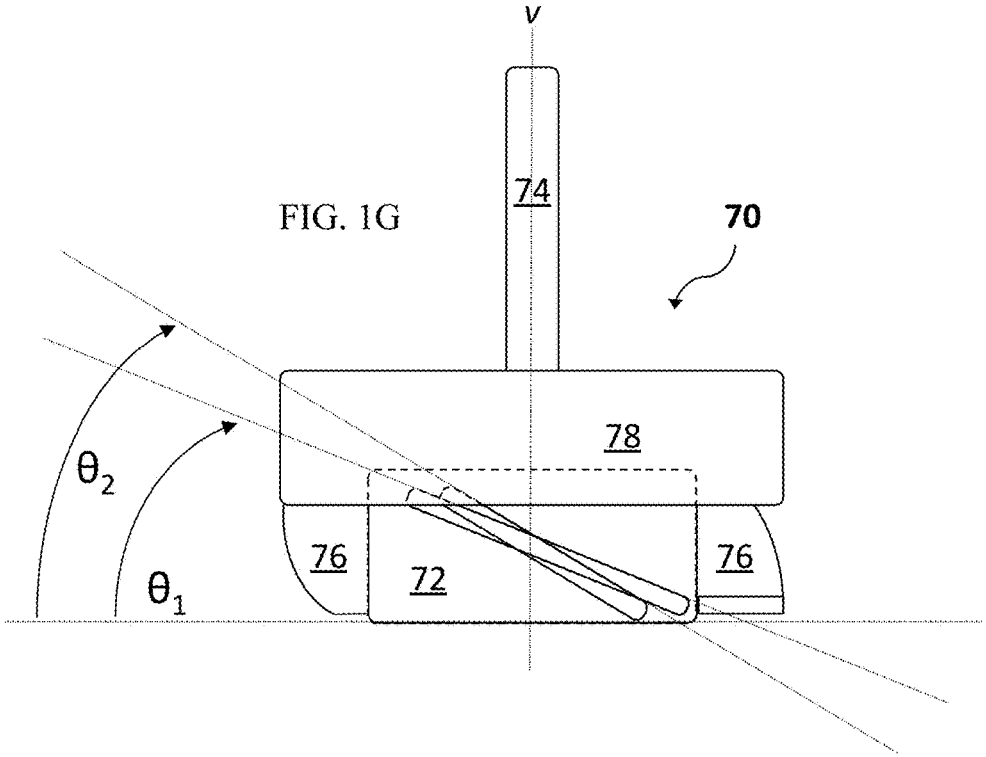

Fins 76 are oriented at an angle about 25° with respect to the top or bottom edge of inner vessel body 72 or ring 78. In some embodiments, the fins on an inner vessel of the invention can have angles between about 20° to about 60° with respect to the top or bottom edge of the inner vessel body or outer cylindrical ring, for example, about 25°, about 30°, or about 35° with respect to the top or bottom edge of the inner vessel body or outer cylindrical ring (FIG. 1G). The fins can have a curvature ranging between about 30° to about 70° with respect to the vertical axis v as shown for inner vessel body 72, for example, about 35°, about 40°, or about 45° with respect to the vertical axis v. As used herein, the term "about" means within 10% of a recited value. The term "vertical axis," as used herein with respect to an inner vessel body, refers to axis of symmetry or axis of rotation of the inner vessel body, and can correspond to a vertical line passing through the center of post, for example, post 74 of inner vessel body 72.

Fins 76 are vertically aligned with respect to the top or bottom of inner vessel body 72 (FIG. 1E); having similar lengths and curvature, they are disposed at similar distances from the top or bottom of inner vessel body 72. The lengths and curvatures of fins 76 are selected using methods known to those skilled in the art taking into account the size of the inner vessel body, for example, its circumference, so as to maintain spacing between the ends of adjacent fins, for example, spacing 77 (FIG. 1D), when uniformly spaced on the exterior lateral surface of inner vessel body 72. And as such fins 76 are horizontally, non-overlapping (FIG. 1D).

Inner vessel 70 also includes outer cylindrical ring 78, which is attached to inner vessel body 72 through fins 76 (FIGS. 1C, 1E-1G). Outer cylindrical ring 78 has lateral surface 78L, the height of which is about ¾ the height of lateral surface 72L. The lateral surface of the outer cylindrical ring of an inner vessel can be about ½ to about 1 & ¼ times the height of the lateral surface of the inner vessel body. For example, wherein the inner vessel body has a height of about 1 inch, the outer cylindrical ring can have a height about 0.8 inches. Outer cylindrical ring 78 encircles the upper portion of fins 76 and inner vessel body 72 through attachment to the upper portions of fins 76. As such, outer cylindrical ring 78 is elevated relative to fins 76 and inner vessel body 72. In addition, outer cylindrical ring 78 is attached to fins 76 through the outer edges of fins 76, the outer edges of fin 76 adjoining the inner lateral surface of outer cylindrical ring 78. As such, outer cylindrical ring 78 forms the upper and widest portion of inner vessel 70, the width of outer cylindrical ring 78 corresponding to the width of the widest portion of inner vessel 70, while inner vessel body 72 and fins 76 form the lower and narrower portion of inner vessel 70, the distance from outer edge to outer edge of opposing fins 76 corresponding to the width of the lower narrow portion of inner vessel 70.

The outer cylindrical ring of an inner vessel of the invention can be elevated or leveled relative to inner vessel body 72. As used herein, the term "elevated" or "leveled with" as used in referenced to the position of the outer cylindrical ring relative to the inner vessel body of an inner vessel of the invention refers to the relative positions of their vertical mid-point. The vertical mid-point of the outer cylindrical ring is a region on the ring half way between the top and bottom circular edges of the cylindrical ring. The vertical mid-point of the inner vessel body is a region on the inner vessel body half way between the circular edge of the open-top and the circular edge of the bottom of the inner vessel body. The outer cylindrical ring is elevated relative to the inner vessel body if the mid-point of the outer cylindrical ring is higher than that of the inner vessel body. The outer cylindrical ring is leveled with the inner vessel body if the mid-point of the outer cylindrical ring is leveled with that of the inner vessel body. Whether at an elevated or leveled position, the lower edge of the outer cylindrical ring can be elevated with respect to the lower edge of the inner vessel body so as to form a body with a wider upper portion and a narrower lower portion. In some embodiments, where the outer cylindrical ring has a height of about ¾ the height of the inner vessel body, the lower edge of the outer cylindrical ring can be elevated with respect to the lower edge of the inner vessel body so as to encircle about the upper 20% to 25% of the inner vessel body to form an inner vessel body with a wider upper half and a narrower lower half.

For example, an inner vessel can have vessel body about 2 inches wide, configured with four equally spaced congruent fins of about 0.5 inches wide. In this embodiment, outer ring can be about 3 and a half to just under 4 inches wide, while the matched outer vessel can have a bottom width of about 4 inches at the bottom to about 4.5 inches at the open top with a vessel body taper between about 1° to about 3°. The outer vessel can be about three times taller than the inner vessel, for example, the outer vessel can have height of between about 5 inches to about 5.5 inches, while the inner vessel can have a height of about 2 inches with a central post extending about 2 to 2.5 inches above the inner vessel.

Inner vessel 70 also include outcome indicator 80, an upward pointing arrow on outer cylindrical ring 78 as shown in FIG. 1C. Outcome indicator 80 indicates the rotational orientation or position of inner vessel 70 relative to outer vessel 20 by, for example, aligning or pointing to an outcome element on outer vessel 20 or to a region or portion of base 30 associated with a particular outcome element. When inner vessel 70 is at the bottom interior of outer vessel 20, outcome indicator 80 on inner vessel 70 points upward toward or in the general vicinity of, and/or rotationally aligns with, one of the outcome element 32 or aligns with a portion of base 30 associated with a particular outcome element 32.

Example 2—Game Apparatus 100

Figure 2A:
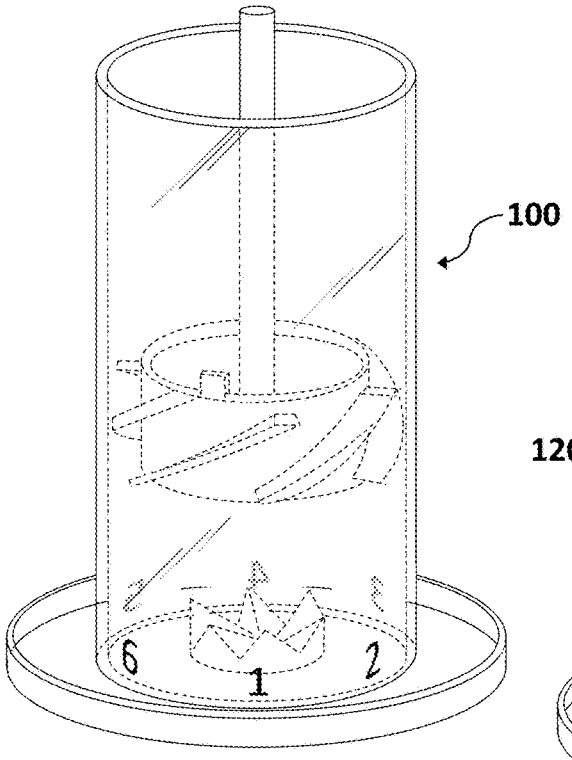
FIGS. 2A-2G are schematic drawings providing various views of a two vessel game apparatus of the invention including: a top perspective view of game apparatus 100 that includes outer vessel and an inner vessel (2A); a perspective view of outer vessel 120 from the top (2B); a perspective view of inner vessel 170 from the top (2C); a top view of outer vessel 120 (2D); a perspective view of inner vessel 170 from the top (2E); a perspective view of inner vessel 170 from the bottom (2F); and a vertical cross-sectional view of inner vessel 170 (2G).
Figure 2B:
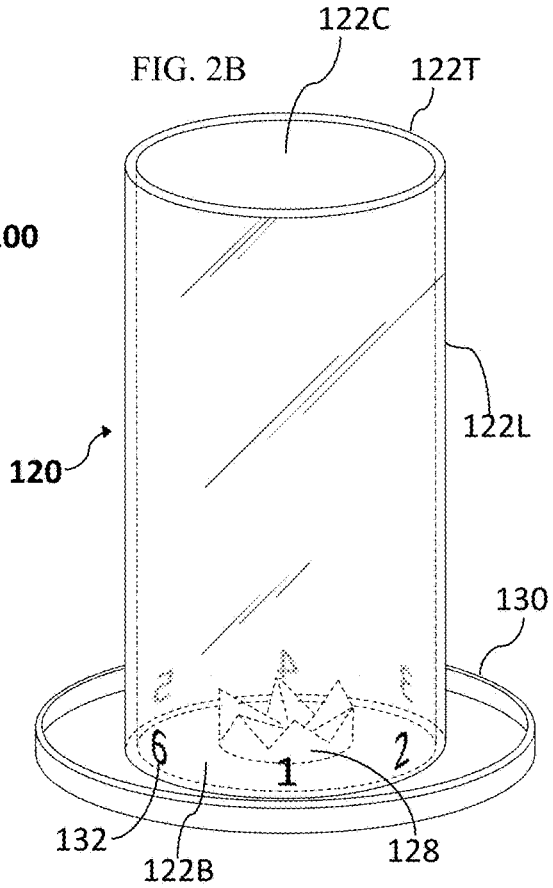
Figure 2C:
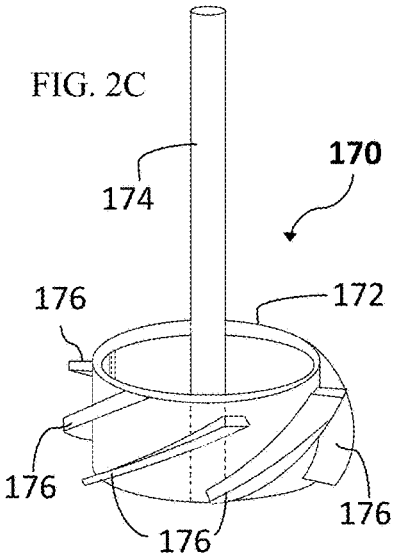
Figure 2D:
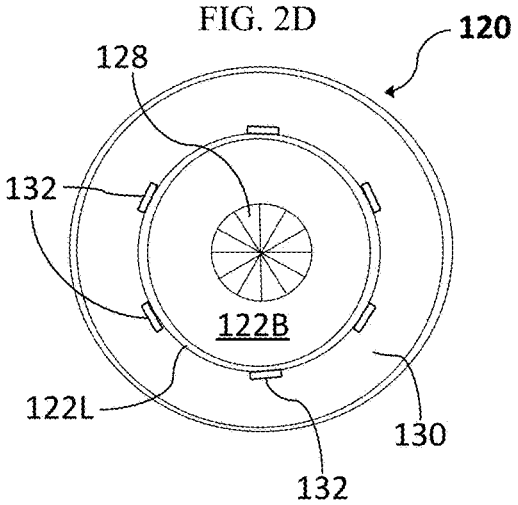

Another embodiment of a game apparatus of the invention is illustrated in FIG. 2A. Game apparatus 100 includes outer vessel 120 (FIG. 2B) and inner vessel 170 (FIGS. 2B, 2C). Outer vessel 120 includes transparent, vessel body 122 and, optionally, base 130 for stability and/or receiving spillage (FIGS. 2B, 2D). Transparent vessel body 122 has lateral wall 122L extending directly upward from bottom 122B to open top 122T to form hollow interior 122C by which outer vessel 120 receives and holds a fluid. As such, transparent body 122 has a cylindrical structure with an open top and hollow center. Transparent body 122 includes inner alignment means 128 disposed on bottom 122B for engaging with inner vessel 170. Transparent body 122 also includes a plurality of outcome elements 132—the numbers 1, 2, 3, 4, 5 and 6—uniformly spaced in a circular pattern on lateral wall 122L (FIGS. 2A, 2B, 2D), the circular pattern of the plurality of outcome elements 132 being concentric with lateral wall 122L. Outcome elements 132 can be at any distance from bottom 122B including, for example, at positions just above bottom 122B (FIG. 2B), level with engagement means 128, above engagement means 128, or midway up the side of lateral wall 122L so long as it is position matched with outcome indicator 180 on inner vessel 170 as discussed herein for outcome elements and outcome indicators on matched inner and outer vessels. In some embodiments, outcome elements 132 can be on base 130 uniformly spaced in a circular pattern that is concentric with lateral wall 122L. Transparent body 122 and/or base 130 can include boundary marks as described above for toroidal base 30. Base 130 can be any shape or configuration sufficient to add stability and/or receive spillage from body 122. For example, base 130 can be a round, oval, square, polygonal flat or concave plate.

Inner vessel 170 is dimensioned to fit inside of body 122 so as to be substantially upright and rotatable on its axis of symmetry when placed into outer vessel body 122 containing a fluid. Inner vessel 170 includes: inner vessel body 172, post 174 extending upwardly from center of inner vessel body 172, six substantially congruent fins 176 on the exterior of lateral wall 172L of inner vessel body 172, alignment means 178 at the underside of inner vessel body 172 for engaging with outer vessel 120, and outcome indicator 180 (FIGS. 2C-2G). Inner vessel body 172 has bottom 172B, lateral wall 172L extending upwardly from the circular edges of bottom 172B to open-top 172T thereby forming hollow interior 172C (FIGS. 2C, 2E-2G). As such, inner vessel body 172 is effective to receive and hold a fluid such as water or beer. Post 174 extends upwardly from the center of bottom 172B and allows inner vessel 170 to be conveniently lifted out of outer vessel 120.

The six substantially congruent fins 176 are flat, helical segments adjoining exterior of lateral wall 172L of inner vessel body 172. Fins 176 allow inner vessel 172 to rotate about its vertical axis as it sinks to the bottom of a fluid-filled outer vessel when placed into a fluid-filled outer vessel. Fin 176 can have a width that is about ⅓ to about ½ the width of inner vessel body 172. Each fin 176 has an inner edge that adjoins the exterior of lateral wall 172L (FIGS. 2C, 2E-2G) and a free outer edge as described above for fin 76. Fin 176 can be oriented at an angle between about 20° to about 60° with respect to the top or bottom edge of inner vessel body 172, for example, about 25°, about 30°, or about 35° with respect to the top or bottom edge of inner vessel body 172 (FIG. 1G). Fin 176 can have a curvature between about 30° to about 70° with respect to the vertical axis of inner vessel body 172, for example, about 35°, about 40°, or about 45° with respect to the vertical axis of inner vessel body 172. As used herein, the term "about" means within 10% of a recited value. The term "vertical axis," as used herein with respect to inner vessel body 172, refers to the axis of symmetry or axis of rotation of inner vessel body 172, and can correspond to a vertical line passing through the center of post 174.

Figure 2E:
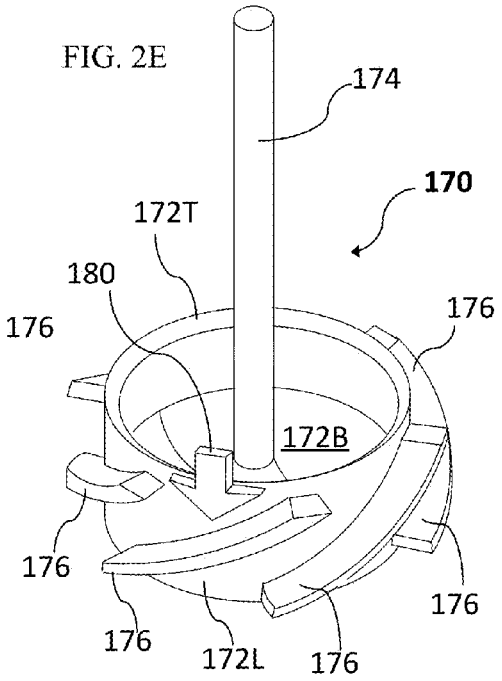
Figure 2F:
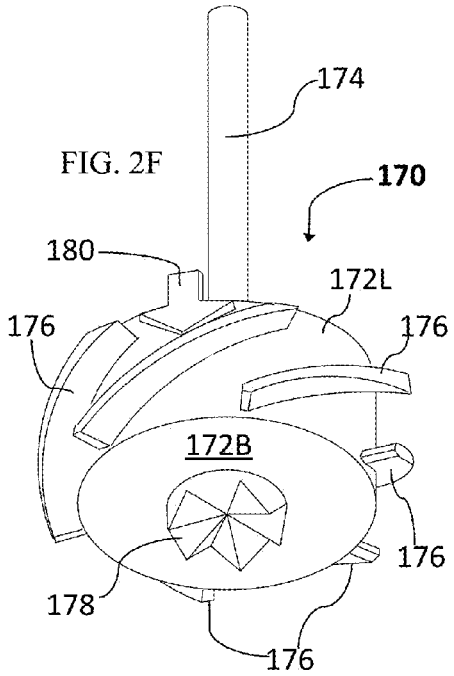
Figure 2G:
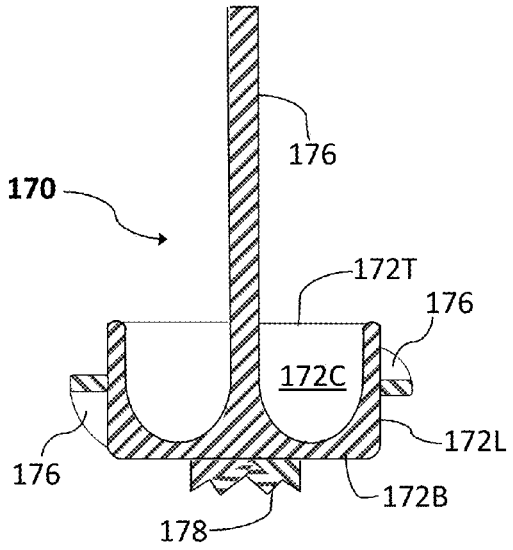

The six fins 176 are vertically aligned with respect to the top or bottom of inner vessel body 172; having similar lengths and curvature, they are disposed at similar distances from the top or bottom of inner vessel body 172. The lengths and curvatures of fins 176 are selected using methods known to those skilled in the art taking into account the size of the inner vessel body, for example, its height and circumference, so as to maintain uniform spacing on the exterior lateral surface of inner vessel body 172 (FIGS. 2E, 2F).

Inner vessel 70 includes alignment means 178, configured to complement alignment means 128 of outer vessel 120. Alignment means 178 adjoins the bottom of inner vessel body 172 and includes a plurality of protrusions and depressions forming a surface contour that complement that of alignment means 128 on the interior bottom of outer vessel 120. Engagement of alignment means 178 of inner vessel 170 with alignment means 128 of outer vessel 120 limits rotational movement of inner vessel 170 and/or allows inner vessel 170 to hold or maintain a stable position when inner vessel 170 reaches the bottom of outer vessel 120 during game play.

Outcome indicator 180 is a downward pointing arrow on inner vessel body 172 (FIG. 2E-2F) that indicates the rotational orientation or position of inner vessel 170 with respect to outer vessel 120. Outcome indicator 180 indicates the rotational orientation or position of inner vessel 170 relative to outer vessel 120 by, for example, aligning or pointing to an outcome element on outer vessel 120 or to a region or portion of outer vessel 120 corresponding to a particular outcome element. When inner vessel 170 is at the bottom interior of outer vessel 120, outcome indicator 180 on inner vessel 170 points downward to the vicinity of, and/or rotationally aligns with, one of the outcome element 132. Engagement of alignment means 128 and 178 allow inner vessel 170 to adopt a position at the bottom interior of outer vessel 120 such that outcome indicator 180 aligns with a particular outcome element 132 on outer vessel 120.

Example 3—Game Apparatus 200

Figure 3A:
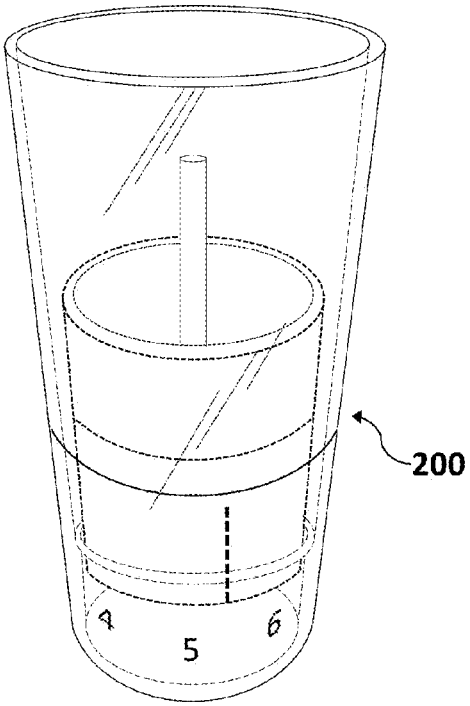
FIGS. 3A-3E are schematic drawings providing various views of a two vessel game apparatus of the invention including: a top perspective view of game apparatus 200 that includes an outer vessel and an inner vessel (3A); a perspective view of outer vessel 220 from the top (3B); a perspective view of inner vessel 70 from the top (3C); a vertical cross-sectional view of outer vessel 220 (3D); and a vertical cross-sectional view of inner vessel 270 (3E).

Another embodiment of a game apparatus of the invention is illustrated in FIG. 3A. Game apparatus 200 includes outer vessel 220 (FIG. 3B) and inner vessel 270 (FIG. 3C).

Figure 3B:
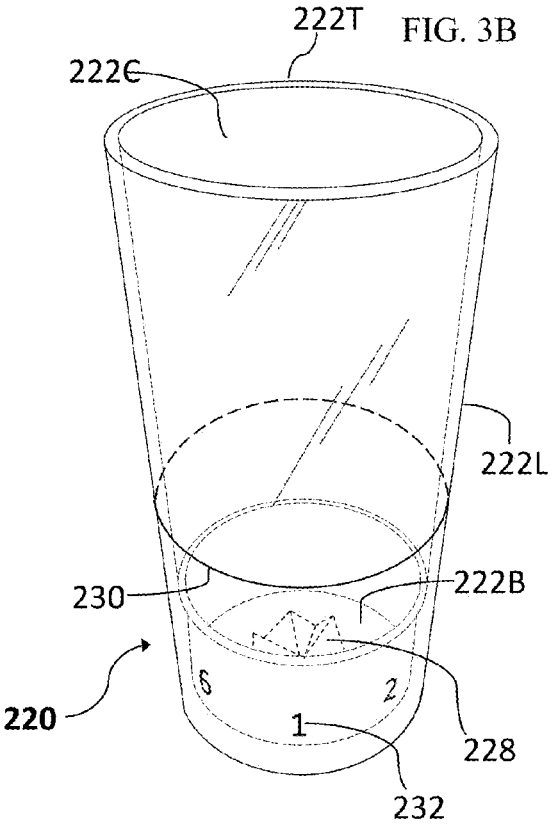
Figure 3C:
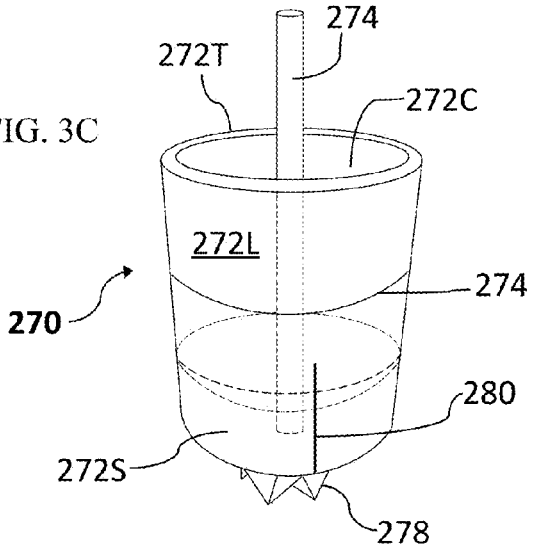

Outer vessel 220 includes transparent body 222 formed by lateral wall 222L, which extends upward and outwardly from circular edge of bottom 222B to form a frusto-conical vessel body having open top 222T and hollow interior 222C thereby enabling outer vessel 220 to receive and hold a fluid (FIG. 3B). Lateral wall 222L includes a thicker lower portion and a thinner upper portion, and as such, hollow interior 222C has a narrower lower portion and a wider upper portion as apparent from the relative diameter $d_1$ and $d_2$ illustrated in FIG. 3D. In another embodiment, the transparent, open-top body of outer vessel 220 can have a cylindrical structure form by a lateral portion that extends directly upward from the circular edge of the bottom resulting in a cylindrical vertical cross-section, the vessel body having a constant width and the hollow interior a constant inner diameter.

Outer vessel 220 includes a plurality of outcome elements 232—the numbers 1, 2, 3 (not shown), 4 (not shown), 5 (not shown) and 6—uniformly spaced in a circular pattern on lateral wall 222L of transparent body 222 (FIGS. 3A-3B), the circular pattern of outcome elements 132 being concentric with lateral wall 222L. Outcome elements 232 can be at any distance from bottom 222B including, for example, at positions just above bottom 222B (FIGS. 3A-3B), level with engagement means 228, above engagement means 228, or midway up the side of lateral wall 222L so long as it is position matched with outcome indicator 280 on inner vessel 270 as discussed herein for outcome elements and outcome indicators on matched inner and outer vessels. In some embodiments, transparent body 222 can include boundary marks as described above for outer vessels 20 and 120.

Figure 3D:
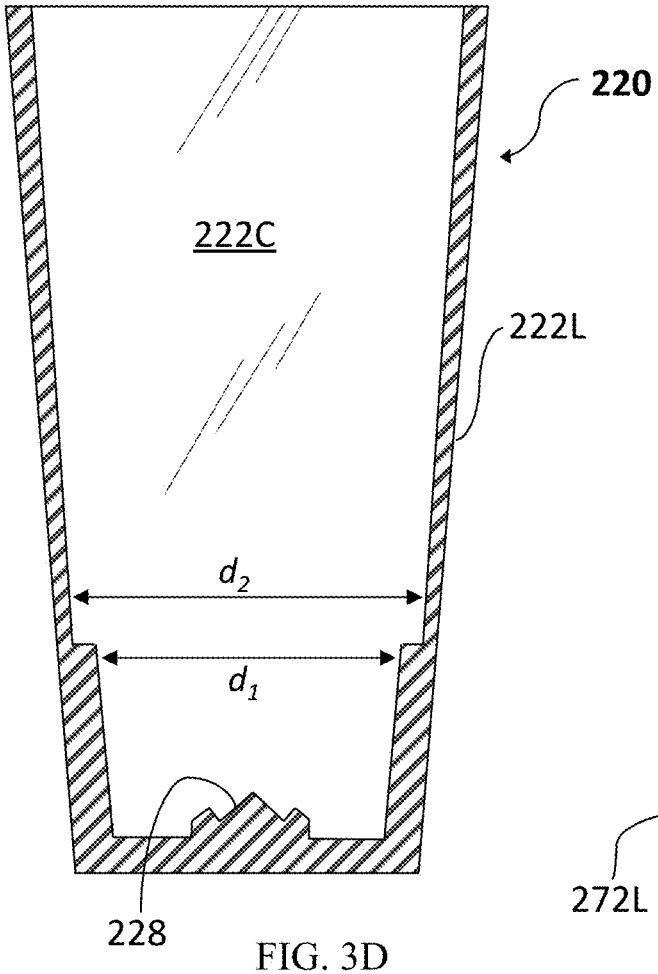

Outer vessel 220 also includes inner alignment means 228 disposed at bottom 222B for engaging with inner vessel 270 (FIG. 3B, 3D). Outer vessel 220 also includes fluid level indicator 230 on the surface of transparent body 222 that indicates a level of fill so as to minimize overflow when inner vessel 270 displaces water as it sinks in the water in outer vessel 220.

Inner vessel 270 (FIGS. 3C, 3E) is dimensioned to fit inside outer vessel body 222 so as to be substantially upright and rotatable on its axis of symmetry when placed into outer vessel body 222 containing a fluid. Inner vessel 270 includes: inner vessel body 272, post 274 extending upwardly from interior center of inner vessel body 272, alignment means 278 on the exterior underside of inner vessel body 272 for engaging with outer vessel 220, fluid level indicator 274, and outcome indicator 280 (FIG. 3C).

Figure 3E:
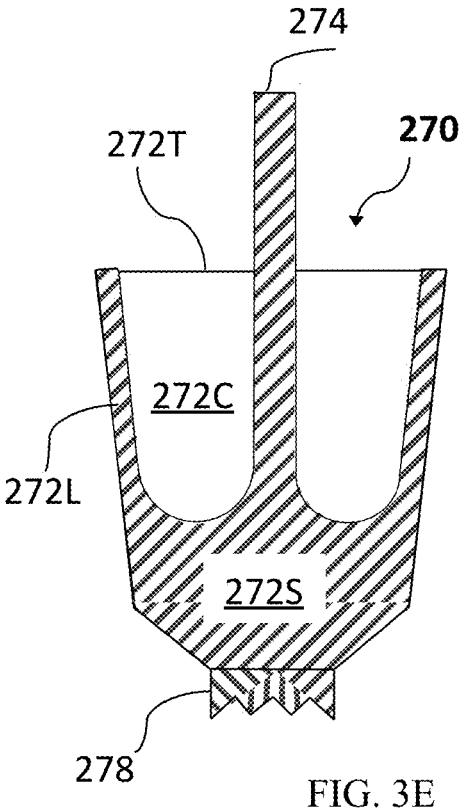

Inner vessel body 272 includes lateral wall 272L extending upward in an outward angle from the circular edge of solid bottom 272S to open top 272T forming hollow interior 272C thereby enabling inner vessel body 272 to receive and hold a fluid (FIGS. 3C, 3E). The lower portion of inner vessel 270 is dimensioned to fit into the narrower lower portion of hollow interior 222C of outer vessel body 222 to facilitate upright positioning of the inner vessel 270 within outer vessel 220 as inner vessel 270 sinks to the bottom of hollow interior 272C and to enable engagement of alignment means 278 on inner vessel 270 with alignment means 228 on outer vessel 220. Solid base 272S adds weight to inner vessel 270 resulting in a bottom heavy vessel. The solid base can enable the inner vessel to maintain a substantially upright position and facilitate sinking of the inner vessel when it is filled to capacity with a fluid such as water. Inner vessel 270 can have a weight from about 25 grams to about 700 grams, for example, about 125, about 150, about 175, about 200, about 250 or about 275 grams. The weight of the inner vessel can be evenly distributed throughout the body of the inner vessel or alternatively, the inner vessel can be bottom heavy, for example, as is inner vessel 270.

Inner vessel 270 includes post 274, which extends upward from base 272S and allows inner vessel 270 to be conveniently lifted out of outer vessel 220.

Alignment means 278 of inner vessel 270 (FIG. 3C, 3E) is configured to complement alignment means 228 of outer vessel 220. Alignment means 278 adjoins the underside of inner vessel body 272 and includes a plurality of protrusions and depressions forming a surface contour that complement that of alignment means 228 on the interior bottom of outer vessel 220. Engagement of alignment means 278 of inner vessel 270 with alignment means 228 of outer vessel 220 limits rotational movement of inner vessel 270 or allows inner vessel 270 to hold position when inner vessel 270 reaches the bottom of outer vessel 220 during game play.

Inner vessel 270 includes outcome indicator 280 (FIG. 3C), a line on lateral wall 272L of inner vessel body 272 that indicates the rotational orientation or position of inner vessel 270 with respect to outer vessel 220. When inner vessel 270 is at the bottom interior of outer vessel 220, outcome indicator 280 on inner vessel 270 can rotationally align with one of outcome element 232 or aligns with a portion of outer vessel 230 near a particular outcome element 32. Engagement of alignment means 228 and 278 allow inner vessel 270 to adopt a position at the bottom interior of outer vessel 220 such that outcome indicator 280 aligns with a particular outcome element 232 on outer vessel 220.

Example 4—Game Apparatus 300

Figure 4A:
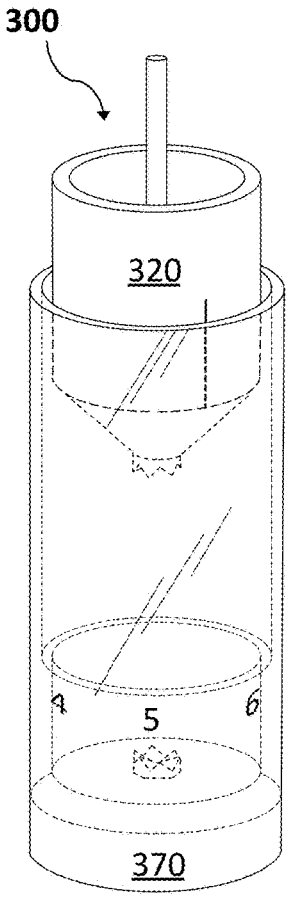
FIGS. 4A-4E are schematic drawings providing various views of a two-vessel game apparatus of the invention including: a top perspective view of game apparatus 300 that includes an outer vessel and an inner vessel (4A); a perspective view of outer vessel 320 from the top (4B); a perspective view of inner vessel 370 from the top (4C); a vertical cross-sectional view of outer vessel 320 (4D); and a vertical cross-sectional view of inner vessel 370 (4E).

Another embodiment of a game apparatus of the invention is illustrated in FIG. 4A. Game apparatus 300 includes outer vessel 320 (FIG. 4B) and inner vessel 370 (FIG. 4C).

Figure 4B:
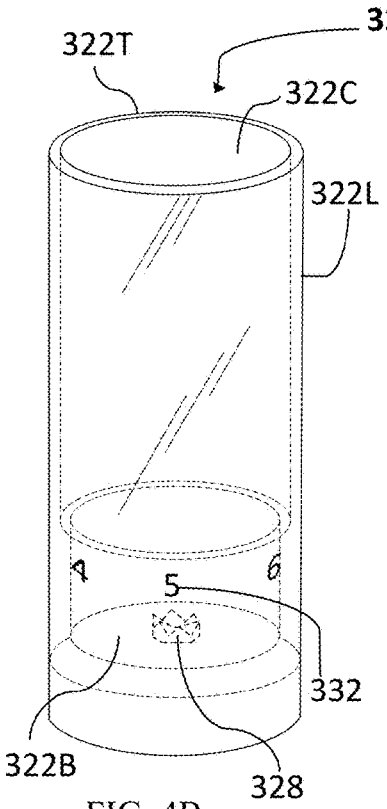
Figure 4D:
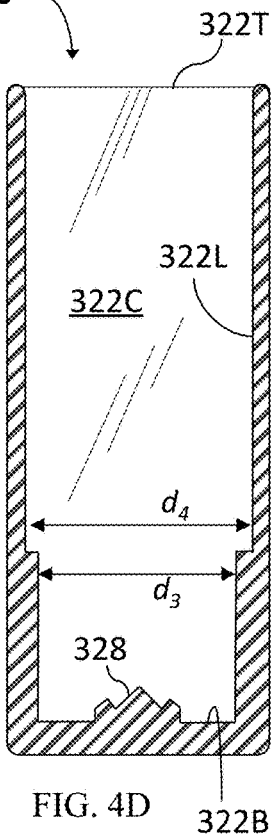
Figure 4C:
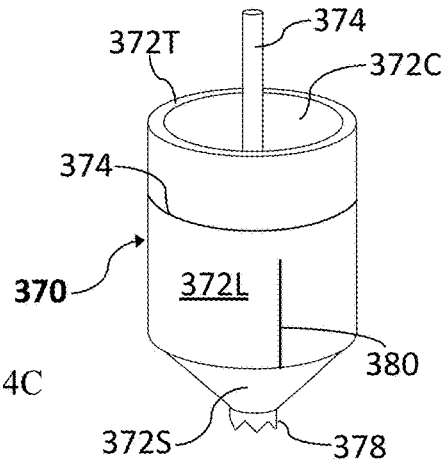

Outer vessel 320 includes transparent vessel body 322 formed by lateral wall 322L, which extends directly upward from circular edge of bottom 322B to form a cylindrical vessel having open top 322T and hollow interior 322C thereby enabling outer vessel 320 to receive and hold a fluid (FIGS. 4B, 4D). Lateral wall 322L includes a thicker lower portion and a thinner upper portion, and as such, hollow interior 322C has a narrower lower portion and a wider upper portion as apparent from the relative diameter $d_3$ and $d_4$ illustrated in FIG. 4D.

Outer vessel 320 includes a plurality of outcome elements 332—the numbers 1 (not shown), 2 (not shown), 3 (not shown), 4, 5 and 6—uniformly spaced in a circular pattern on lateral wall 322L of transparent body 322 (FIGS. 4A-4B), the circular pattern of outcome elements 132 being concentric with lateral wall 322L. Outcome elements 332 can be at any distance from bottom 322B including, for example, at positions just above bottom 322B (FIGS. 4A-4B), level with engagement means 328, above engagement means 328, or midway up the side of lateral wall 322L so long as it is position matched with outcome indicator 380 on inner vessel 370 as discussed herein for outcome elements and outcome indicators on matched inner and outer vessels. In some embodiments, transparent body 322 can include boundary marks as described above for outer vessels 20, 120, and 220.

Outer vessel 320 also includes inner alignment means 328 disposed at bottom 322B for engaging with inner vessel 370 (FIG. 4B, 4D). In some embodiments, outer vessel 320 can include a water mark, i.e., any visible line, mark, depression, ridge or any combination thereof on the surface of transparent body 322 that indicates a level of fill so as to minimize overflow when inner vessel 370 displaces water as it sinks in the water in outer vessel 320.

Inner vessel 370 (FIGS. 4C, 4E) is dimensioned to fit inside body 322 so as to be substantially upright and rotatable on its axis of symmetry when placed into outer vessel body 322 containing a fluid. Inner vessel 370 includes: inner vessel body 372, post 374 extending upwardly from interior center of inner vessel body 372, alignment means 378 on the exterior underside of inner vessel body 372 for engaging with outer vessel 320, fluid level indicator 374, and outcome indicator 380 (FIG. 4C).

Figure 4E:
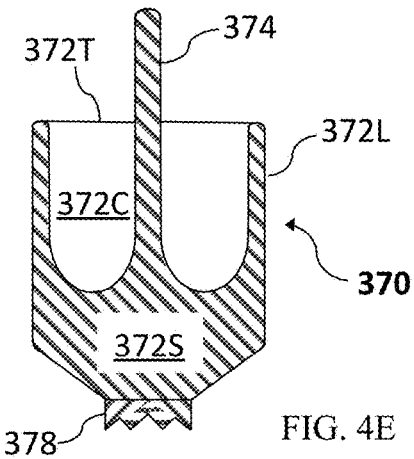

Inner vessel body 372 includes lateral wall 372L extending directly upward from the circular edge of solid base 372S to open top 372T forming hollow interior 372C thereby enabling inner vessel body 372 to receive and hold a fluid (FIGS. 4C, 4E). The width of inner vessel 370 is dimensioned to fit into the narrower, lower portion of hollow interior 372C of outer vessel body 322 to facilitate upright positioning of inner vessel 370 within outer vessel 320 as inner vessel 370 sinks to the bottom of hollow interior 372C and to enable engagement of alignment means 378 on inner vessel 370 with alignment means 328 on outer vessel 320. Solid base 372S adds weight to inner vessel 370 resulting in a bottom heavy vessel. The weighted solid base can enable the inner vessel to maintain a substantially upright position and facilitate sinking when it is filled to capacity with a fluid such as water. Inner vessel 370 can have a weight from about 25 grams to about 700 grams, for example, about 125, about 150, about 175, about 200, about 250 or about 275 grams.

Inner vessel 370 includes post 374, which extends upward from base 372S and allows inner vessel 370 to be conveniently lifted out of outer vessel 320.

Alignment means 378 of inner vessel 370 (FIG. 4C, 4E) is configured to complement alignment means 328 of outer vessel 320. Alignment means 378 adjoins the underside of inner vessel body 372 and includes a plurality of protrusions and depressions forming a surface contour that complement that of alignment means 328 on the interior bottom of outer vessel 320. Engagement of alignment means 378 with alignment means 328 limits rotational movement of inner vessel 370 or allows inner vessel 370 to hold a particular position when inner vessel 370 sinks to the bottom of outer vessel 320 during game play.

Inner vessel 370 includes outcome indicator 380 (FIG. 4C), a line on lateral wall 372L of inner vessel body 372 that indicates the rotational orientation or position of inner vessel 370 with respect to outer vessel 320. When inner vessel 370 is at the bottom interior of outer vessel 320, outcome indicator 380 on inner vessel 370 can rotationally align with a particular outcome element 332. Engagement of alignment means 328 and 378 allow inner vessel 370 to adopt a position at the bottom interior of outer vessel 320 such that outcome indicator 380 aligns with a particular outcome element 332 on outer vessel 320.

Example 5—Game Rules I

Figure 5A:
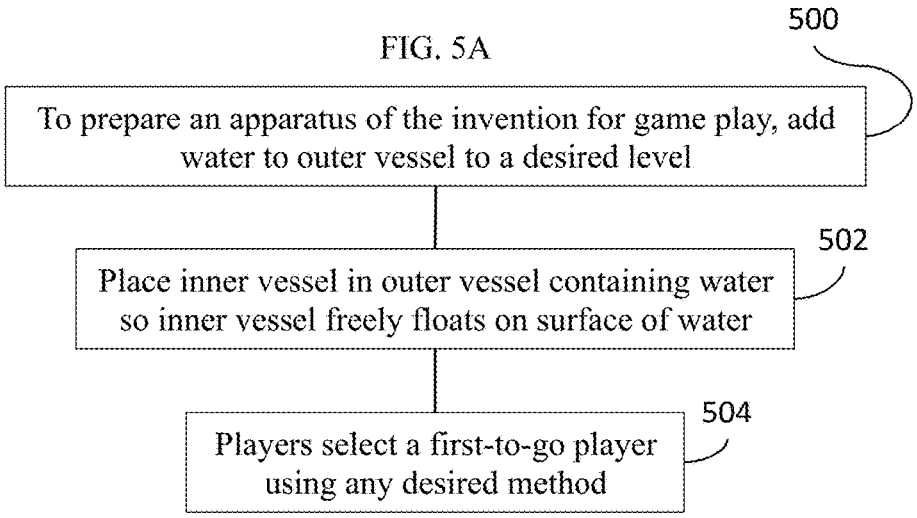
FIGS. 5A-5C are flowcharts summarizing alternative methods of playing a game using the two-vessel game apparatus of the invention.
Figure 5B:
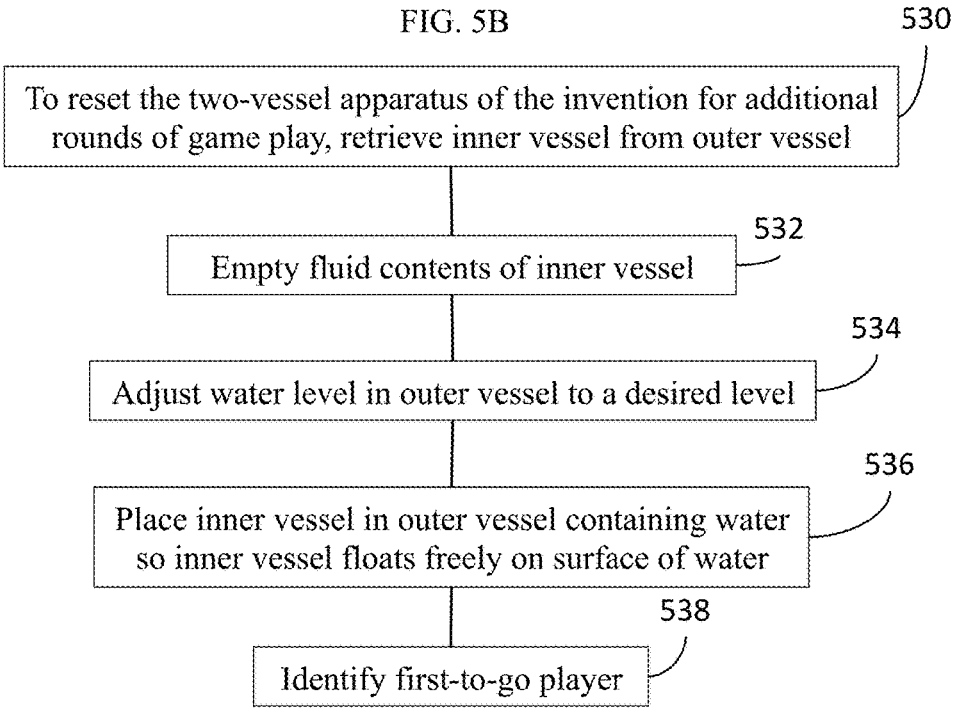
Figure 5C:
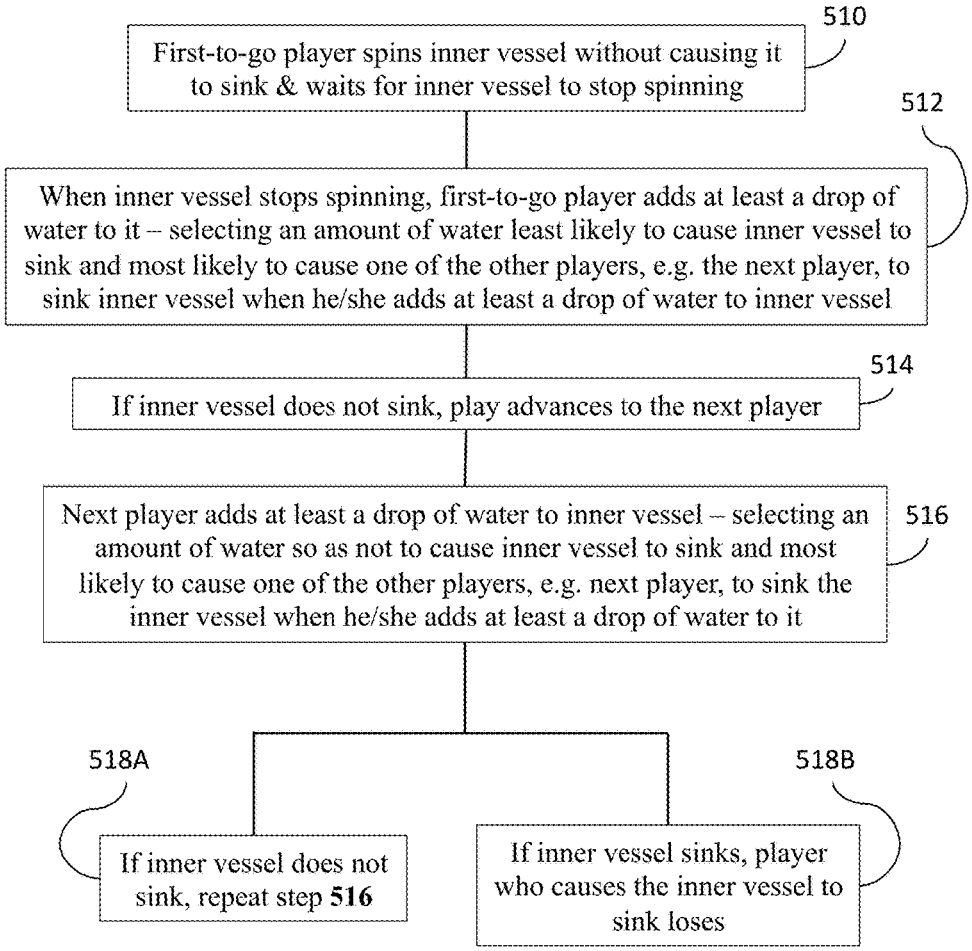

A method of playing a game using a game apparatus of the invention is summarized in FIGS. 5A-5C.

To set up the apparatus for game play (FIG. 5A), a desired amount of water is added to the outer vessel (500). The outer vessel can be filled to about ¾ full, to the water line if the outer vessel includes a water line, or to any other level. The desired level of water can be: (1) about ¾ full; (2) about the level indicated by a water line if the outer vessel includes a water line; (3) the level of water sufficient for the accompanying inner vessel body to be fully submerged when it sinks; (4) a level of water that is more than the level of water sufficient to enable the inner vessel to be fully submerged; or (6) any amount of water selected by the players. When the outer vessel is filled with the desired amount of water, the accompanying inner vessel is placed into the outer vessel on the surface of the water, allowing it to float freely on the water surface (502). The players select a first-to-go player using any desired method (504). Any number of players, e.g. two or more players, can play the game, and a player can join or withdraw anytime game play.

To begin the game (FIG. 5C), the first-to-go player spins the floating inner vessel without causing it to sink and then waits for the inner vessel to stop spinning (510). When floating inner vessel stops spinning, the first-to-to player adds at least a drop of water to the inner vessel (512). If the inner vessel does not sink, the game then advances to the next player (514). Next player takes his/her turn by adding at least a drop of water to the inner vessel body (516). If inner vessel does not sink, step 516 is repeated, if inner vessel sinks, the player who causes the inner vessel to sink loses and the round ends (518). In some embodiments (FIG. 5D), the player who loses the round draws a karma card from a deck of karma cards (520). The player who draws a karma card performs the action described in the karma card drawn (522).

To continue with the game after a round ends, the apparatus can be reset for game play by performing steps analogous to steps 500-504 for setting up the apparatus for game play (FIG. 5B). The inner vessel is retrieved (530), the fluid contents of the inner vessel is emptied (532), the level of water in the outer cup is adjusted if needed or desired (534), the inner vessel is placed in the outer vessel to float freely on the surface of the water in the outer vessel (536), and a first-to-go player is identified (538). The first-to-go player can be the player who lost the previous round, the next player in line after the player who lost the previous round, or any player selected by the group of players using any method.

The game can be played as many rounds as the players desired. Each round of the game is played through performing steps 510-518 (FIG. 5C) and, optionally, steps 540-548, 550-556, 560-568, 570-578, 580-590, or any combination thereof as further discussed below (FIGS. 6A-6E). In between rounds, the game apparatus is reset for the next round through performing steps 530-538 (FIG. 5B).

In a method of the invention, spinning the inner vessel (510) prevents the first-to-go player from affecting the sink-outcome of the game by placing the inner vessel in the water at any select orientation or position. Thus, typically, the first-to-go player is the only player to spin the inner vessel. Although each player must add at least a drop of water to the inner vessel to complete a turn (steps 512, 516), typically, each player adds the amount of water he/she believes is least likely to cause the inner vessel to sink, and most likely to cause one of the remaining players, for example, the next player, to sink the inner vessel by adding at least a drop of water to the inner vessel.

The game is best played on a countertop or a hard non-movable surface to minimize the likelihood of jolting and to avoid inadvertently disturbing the floating inner vessel. A player who purposely causes the inner vessel to sink loses that round of the game. The game provides for a pause of a few seconds between players, for example, about 3-10 seconds, e.g. 3, 4, 5 seconds or so as determined by the players, to allow the inner vessel to stabilize or sink. For example, if the players agree on a pause of about 5 seconds, then where inner vessel is floating so close to the edge that it sinks within the about 5 seconds, the previous player loses the round. In some embodiments, the players can agree that if the inner vessel sinks after about 5 seconds, the next player loses the round. The passage of time can be measured using any methods agreed by the players including, for example, counting to 3, Mississippi style. Each time a player adds at least a drop of water to the inner vessel without sinking the inner vessel, the game advances to the next player (514, 516, 518). The game can advance in any direction, for example, clockwise, counter clockwise, or in a random or arbitrary fashion, each player taking a turn to add at least a drop of water to the inner vessel until the round ends when a player loses by causing the inner vessel body to sink.

Example 6—Game Rules II

FIGS. 6A-6E summarize additional methods of playing a game using an apparatus of the invention.

In some embodiments, the game can be played with a set of karma cards 701-757 (FIGS. 6A & 9A-9F). Player(s) set up the game apparatus according to steps 500-504 (550) and the game is played according to steps 510-518. The player who causes the inner vessel to sink draws a karma card (FIGS. 9A-9B) from a set of karma cards 701-757 (544) and performs the act described on the karma card drawn (546). Examples of karma acts are provided on karma cards 701-757 illustrated in FIGS. 9A-9F. After performing the karma acts, the round ends and player(s) reset apparatus for another round of play if desired (548). Between rounds of the game, the apparatus is reset according to steps 530-538 and the game continues according to steps 542-546 until player(s) decide to end play (548).

Figure 6A:
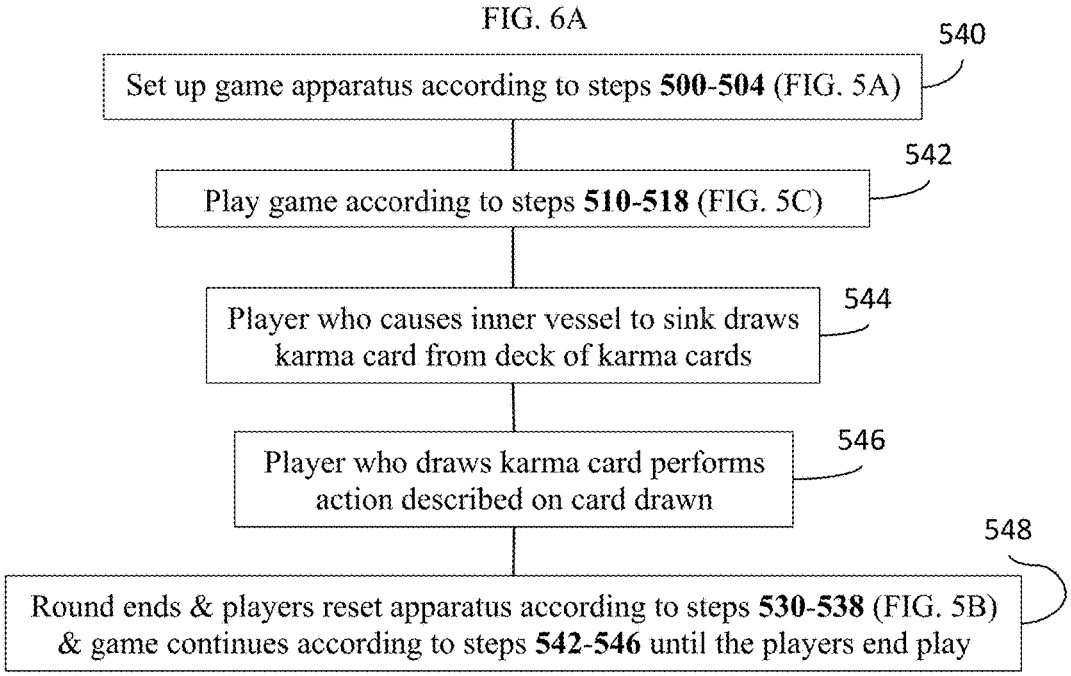
FIGS. 6A-6E are flowcharts summarizing additional methods of playing a game of using the two-vessel game apparatus of the invention.
Figure 6B:
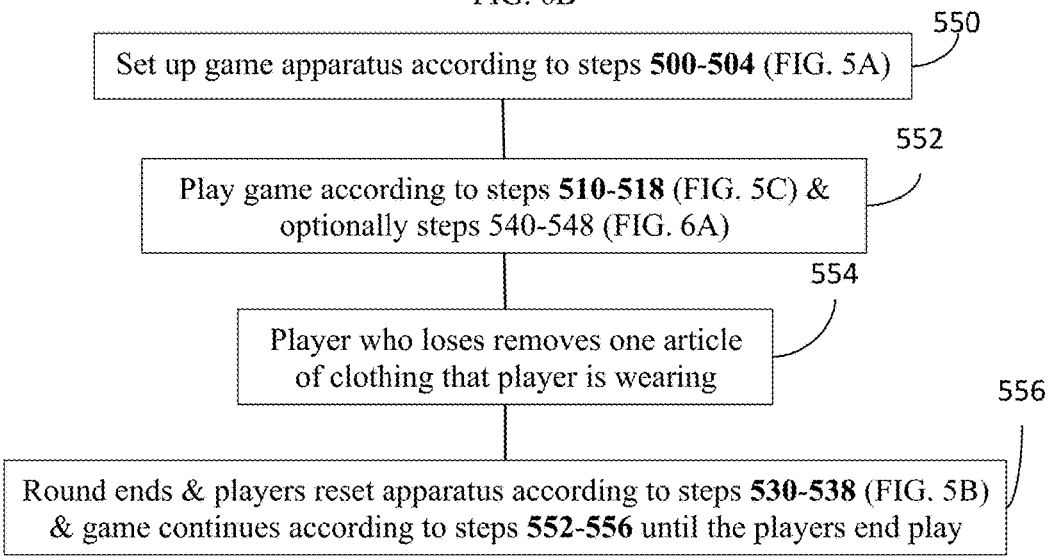

In some embodiments, the game can be played according to rules that require a player who causes the inner vessel to sink remove an article of clothing that player is wearing (FIG. 6B). Player(s) set up the game apparatus according to steps 500-504 (550) and the game is played according to steps 510-518, and optionally, steps 540-548 (552). The player who causes the inner vessel to sink loses a round and removes one article of clothing that he/she is wearing (554). Between rounds of the game, the apparatus is reset according to steps 530-538 and the game continues according to steps 552-556 until player(s) decide to end play (556).

Figure 6C:
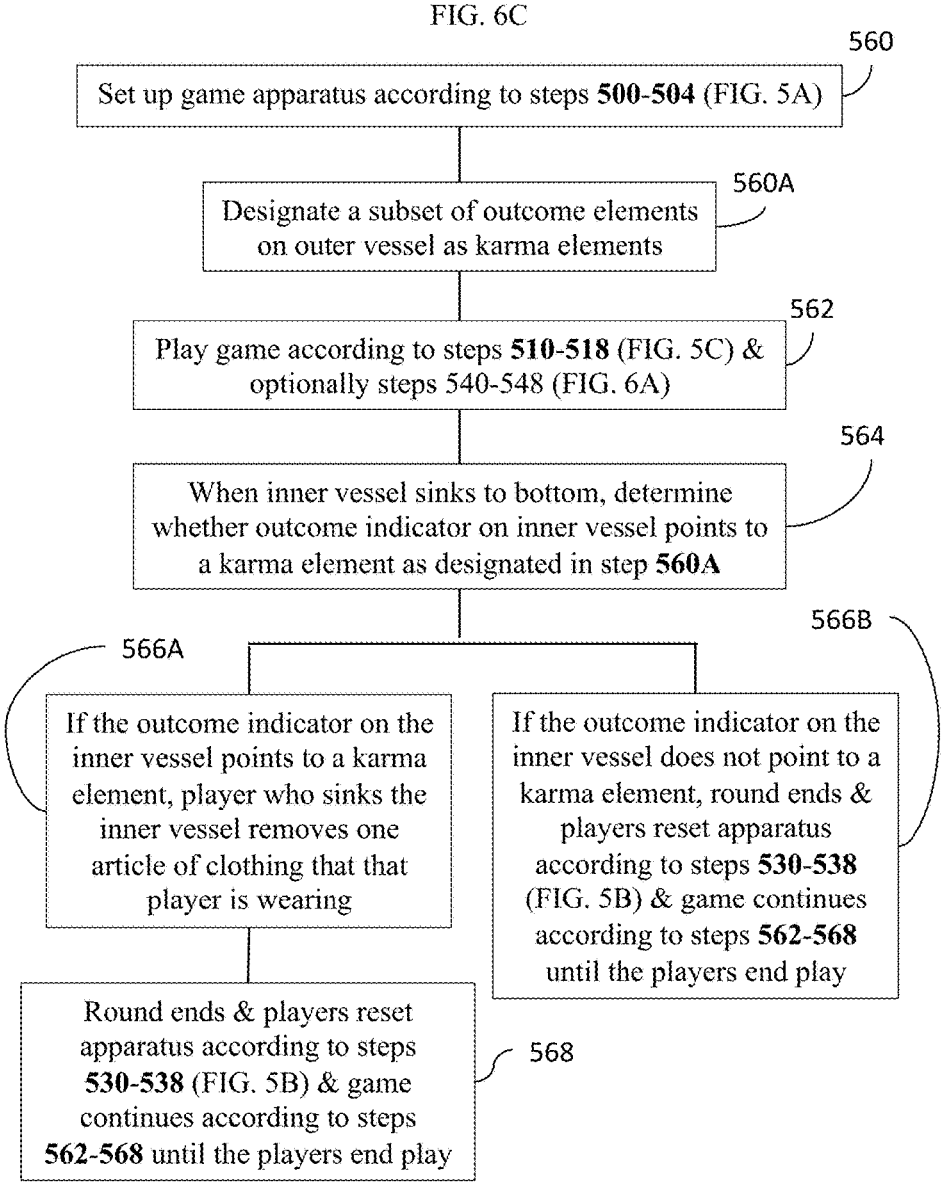

In some embodiments, the game can be played according to rules that require a player who causes the inner vessel to sink remove an article of clothing that player is wearing if the inner vessel sinks to one position of a subset of pre-determined positions (FIG. 6C). More specifically, player(s) set up the game apparatus according to steps 500-504 (560). Prior to, after, or concurrent with setting up the game apparatus in step 560, the players can designate a subset of outcome elements on the outer vessel as karma elements (560A). For example, where the outcome elements are the numbers 1, 2, 3, 4, 5, and 6, the subset of outcome elements that can be designated as karma elements can be the odd numbers, the even numbers, the first three numbers, the last three numbers or any arbitrary or non-arbitrary combination of the numbers 1-6. The game is then played according to steps 510-518 of FIG. 5C, and optionally, steps 540-548 of FIG. 6A (562). When the inner vessel sinks to the bottom, the players determine whether the outcome indicator on the inner vessel points to a karma element designated in step 560A (564). If the outcome indicator points to a karma element designated in step 560A, the player who sinks the inner vessel and loses the round removes one article of clothing that he/she is wearing (566A). The round ends and players reset the apparatus for another round of play if desired (568). If the outcome indicator on the inner vessel does not point to a karma element, the round also ends and players reset the apparatus for another round of game play if desired (566B). The outcome indicator "points to" a designated outcome element if the outcome indicator points to the designated outcome element or points to a region on the outer vessel associated with the designated outcome element. Between rounds of the game, the apparatus is reset according to steps 530-538 (FIG. 5B) and the game continues according to steps 562-568 until player(s) decide to end play (566B, 568).

Figure 6D:
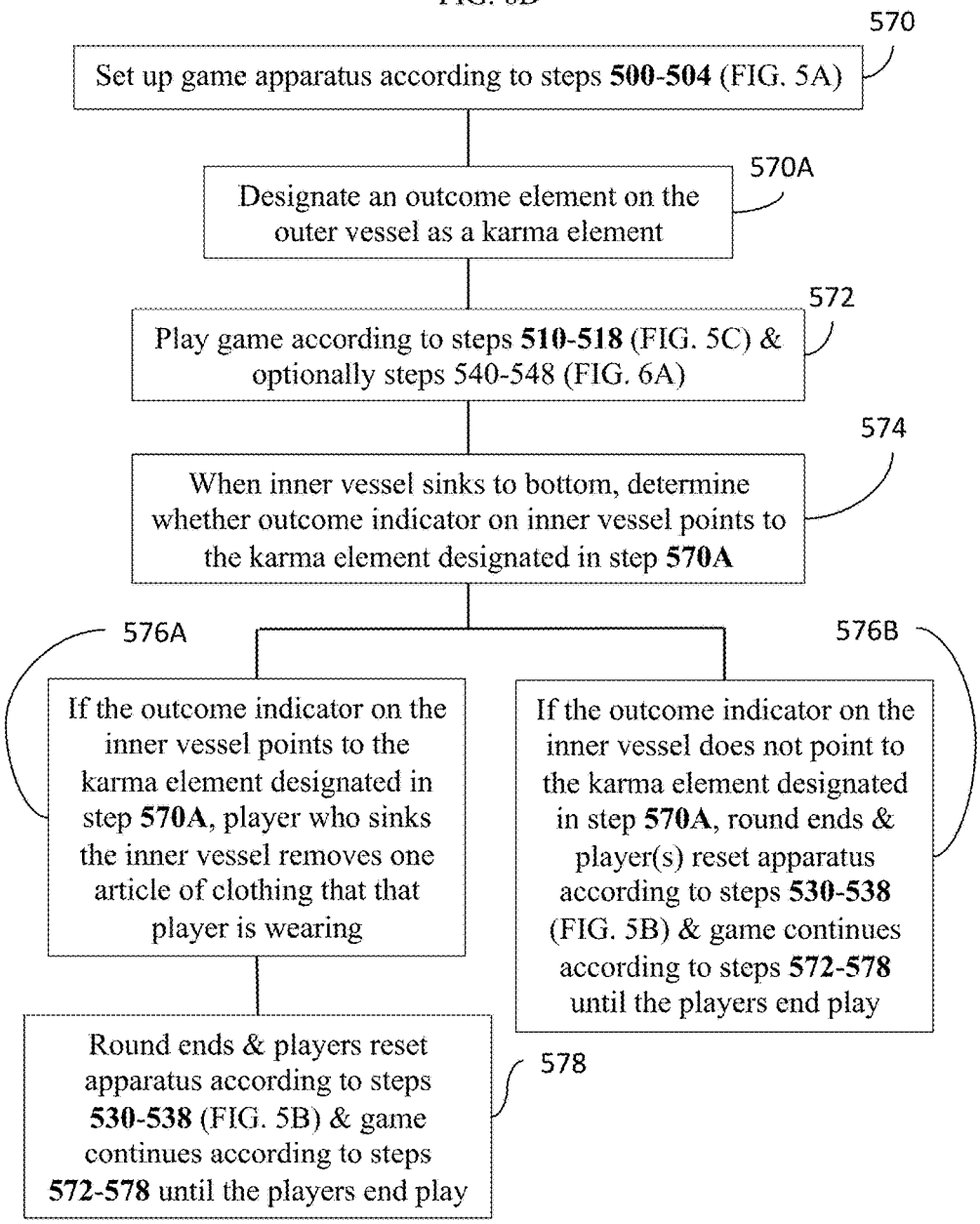

In another embodiment, the game can be played according to rules that require a player who causes the inner vessel to sink remove an article of clothing that player is wearing if the inner vessel sinks to a pre-determined position (FIG. 6D). More specifically, player(s) set up the game apparatus according to steps 500-504 (570). Prior to, after, or concurrent with setting up the game apparatus in step 570, the players can designate a particular outcome element on the outer vessel as a karma element (570A). For example, where the outcome elements are the numbers 1, 2, 3, 4, 5, and 6, any one of these numbers, for example, the number 6, can be designated as the karma element. The game is then played according to steps 510-518 of FIG. 5C, and optionally, steps 540-548 of FIG. 6A (572). When the inner vessel sinks to the bottom, the players determine whether the outcome indicator on the inner vessel points to the karma element designated as such in step 570A (574). If the outcome indicator points to the karma element designated in step 570A, the player who sinks the inner vessel and loses the round removes one article of clothing that he/she is wearing (576A). The round ends and players reset the apparatus for another round of play if desired (578). If the outcome indicator on the inner vessel does not point to a karma element, the round also ends and players reset the apparatus for another round of game play if desired (576B). The outcome indicator "points to" a designated outcome element if the outcome indicator points to the designated outcome element or points to a region on the outer vessel associated with the designated outcome element. Between rounds of the game, the apparatus is reset according to steps 530-538 (FIG. 5B) and the game continues according to steps 572-578 until the player decide to end play (576B, 578).

Figure 6E:
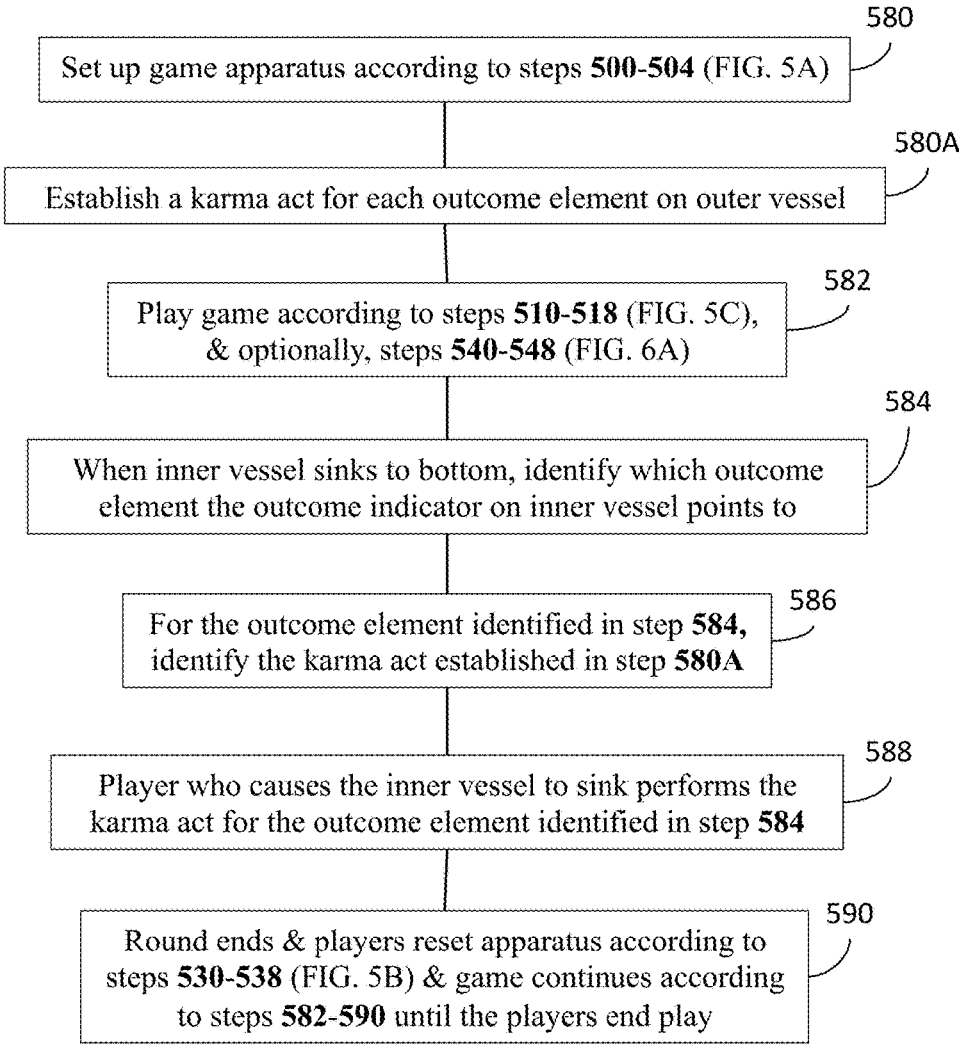

In another embodiment, the game can be played according to rules that require a player who causes the inner vessel to sink perform a pre-determined act (FIG. 6E). More specifically, player(s) set up the game apparatus according to steps 500-504 (580). Prior to, after, or concurrent with setting up the game apparatus in step 580, the players establish a karma act for each outcome element on the outer vessel (580A). For example, where the outcome elements are the numbers 1, 2, 3, 4, 5, and 6, the players can agree upon a karma act for each of the numbers, or each player can establish a personal set of karma acts, one act for each of the numbers from 1 to 6. Non-limiting examples of karma act can be as follows: (a) take a shot, (b) finish your drink, (c) take two drinks, (d) take three drinks, (e) take four drinks, (f) take five drinks, (g) remove article of clothing, (h) player to your right ask you a truth, (i) player to your left gives you a dare, (j) everyone takes a drink, (k) do nothing, (1) make a rule, (m) finish the drink of the player to your right, and (n) finish the drink of the player to your left.

In one embodiment, the players can agree to the following karma acts: (a) outcome element 1—Player to your right gives you a dare; (b) outcome element 2—Player to your left gives you a dare; (c) outcome element 3—no truth or dare; (d) outcome element 4—player to your right asks you a question and you must answer truthfully; (e) outcome element 5—Player to your left asks you a question and you must answer truthfully; and (f) outcome element 6—no truth or dare. In another embodiment, the players can agree to the following karma acts: (a) outcome element 1—Player to your right asks you a question and you must answer truthfully; (b) outcome element 2—Player to your left asks you a question and you must answer truthfully; (c) outcome element 3—no truth; (d) outcome element 4—player to your right asks you a question and you must answer truthfully; (e) outcome element 5—Player to your left asks you a question and you must answer truthfully; and (f) outcome element 6—no truth. In another embodiment, the players can agree to the following karma acts: (a) outcome element 1—Player to your right gives you a dare; (b) outcome element 2—Player to your left gives you a dare; (c) outcome element 3—no dare; (d) outcome element 4—player to your right gives you a dare; (e) outcome element 5—Player to your left gives you a dare; and (f) outcome element 6—no dare.

Figure 7:
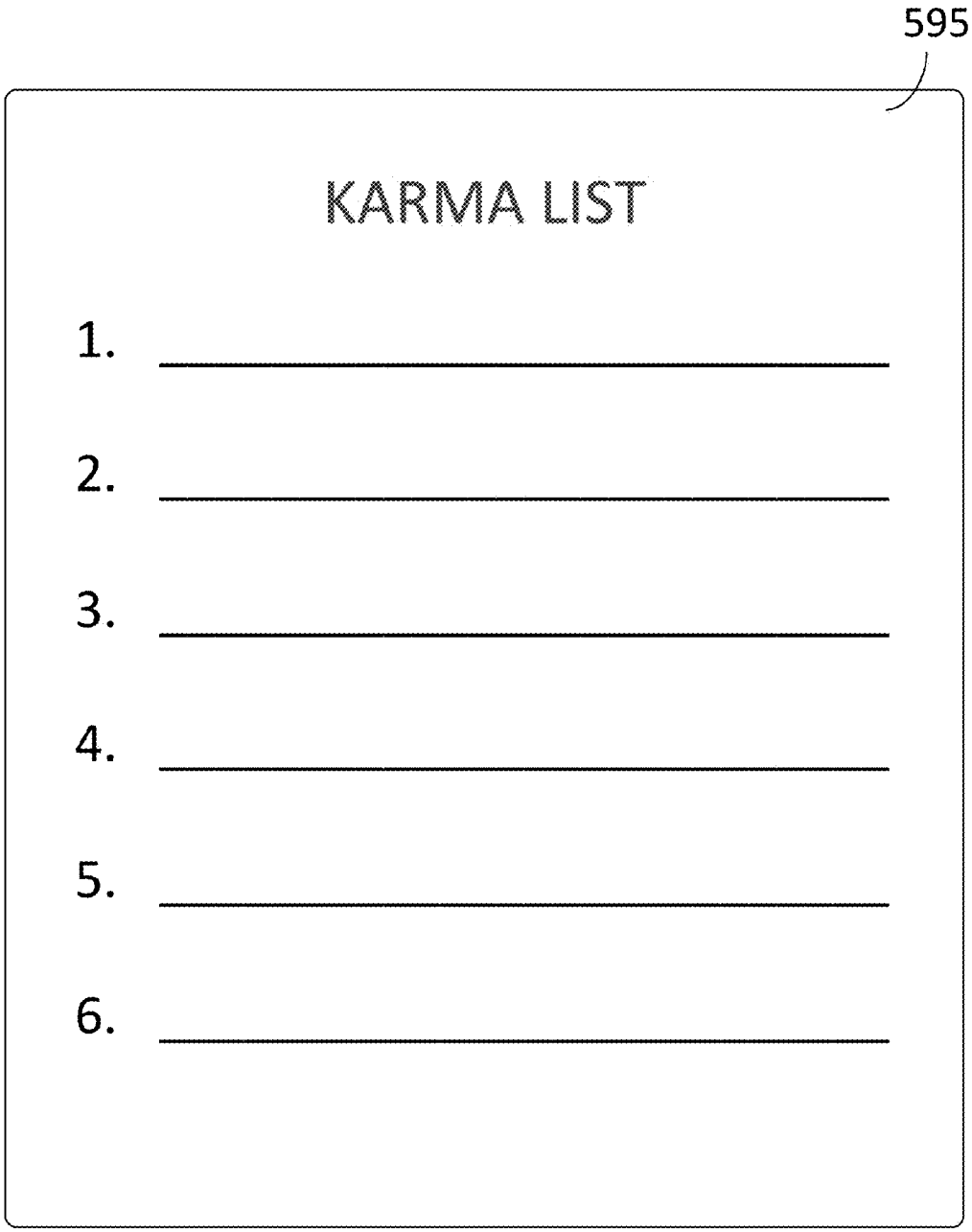
FIG. 7 is an illustration of a karma list that can be used in a game of the invention.

The karma acts can be recorded for example on a table as shown in FIG. 7. The game is then played according to steps 510-518 of FIG. 5C, and optionally, steps 540-548 of FIG.

6A (582). When the inner vessel sinks to the bottom, the players determine which outcome element on the outer vessel the outcome indicator on the inner vessel points to (584). For the outcome element identified in step 584, the players determine the karma act established for that outcome element in step 580A (586). The player who caused the inner vessel to sink performs the karma act established for the outcome element identified (588). The round ends and players reset the apparatus for another round of play if desired (590). The outcome indicator "points to" a designated outcome element if the outcome indicator points to the designated outcome element or points to a region on the outer vessel associated with the designated outcome element. Between rounds of the game, the apparatus is reset according to steps 530-538 (FIG. 5B) and the game continues according to steps 582-590 until the players decide to end play (590).

Example 7—Game Rules III

Figure 8A:
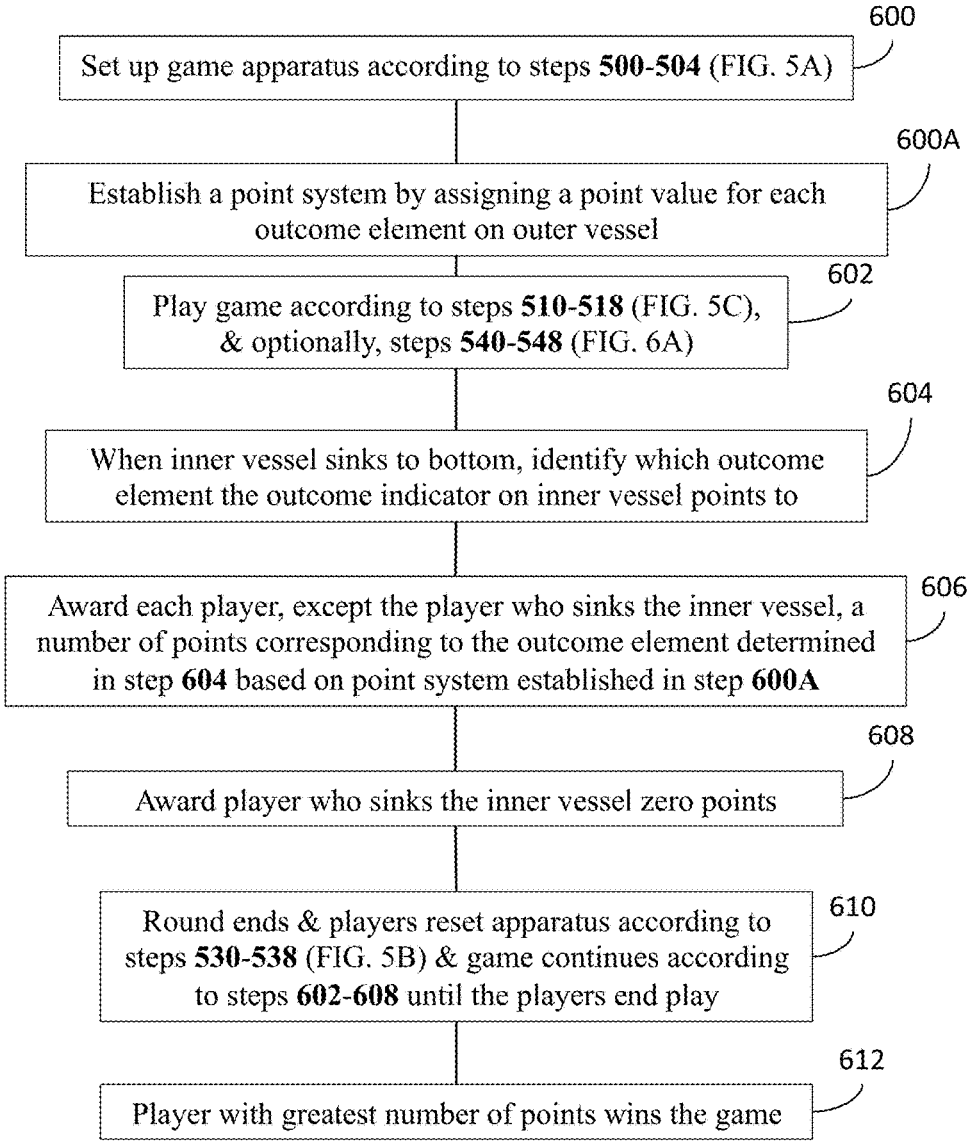

FIGS. 8A & 8B provide another method of playing a game using an apparatus of the invention.

In another embodiment, the game can be played according to rules that award points to all players but the player who sinks the inner vessel and loses the round (FIG. 8A). In this embodiment, the player with the greatest points at the end of the game wins. More specifically, player(s) set up the game apparatus according to steps 500-504 (600). Prior to, after, or concurrent with setting up the game apparatus in step 600, the players establish a point system by assigning a point value for each outcome element on the outer vessel (600A). For example, where the outcome elements are the numbers 1, 2, 3, 4, 5, and 6, the players can assign a value of 1, 2, 3, 4, 5, or 6, respectively, each of the numbers. Any arbitrary or non-arbitrary point value can be assigned to each outcome element. The point value can be based on the numeric value of the outcome element if the outcome element is a number. The game is then played according to steps 510-518 of FIG. 5C, and optionally, steps 540-548 of FIG. 6A (602). When the inner vessel sinks to the bottom, the players identify which outcome element on the outer vessel the outcome indicator on the inner vessel points to (604). Each player, except the player who causes the inner vessel to sink, is awarded a number of points corresponding to the outcome element identified in step 604 based on point system established in step 600A (606). The player who caused the inner vessel to sink receives zero points (608). Points can be recorded on a score sheet, for example, as shown in FIG. 8B. The round ends and players reset the apparatus for another round of play if desired (610). The outcome indicator "points to" a designated outcome element if the outcome indicator points to the designated outcome element or points to a region on the outer vessel associated with the designated outcome element. Between rounds of the game, the apparatus is reset according to steps 530-538 (FIG. 5B) and the game continues according to steps 602-610 until the players decide to end play, at which time, the player with the greatest number of points wins (612). Total points can be determined after two rounds of play and then after successive rounds as or when players decide to end play.

Other Embodiments

While the invention has been described in conjunction with the detailed description, the foregoing description is intended to illustrate and not limit the scope of the invention defined by the claims. Modification and variation of the concepts herein disclosed may be resorted to by those skilled in the art, and such modifications and variations are considered to be within the scope of this invention. The invention has been described broadly and generically herein. Each of the narrower species and subgeneric groupings falling within the generic disclosure form part of the invention.

As used herein and in the appended claims, the singular forms "a," "an," and "the" include the plural unless the context clearly dictates otherwise. As used herein, the term "about" in reference to a numeric value means within 10% of the numeric value.

What is claimed is:

1. An apparatus for playing a game comprising a pair of matched vessels, the matched vessels comprising an inner vessel and an outer vessel, (a) each vessel comprising a fully closed bottom wall with a circular edge and a lateral wall adjoining the circular edge that extends upward to form a vessel body with a hollow interior effective to hold a fluid without leakage and a circular open top through which the fluid can be added to the hollow interior;

(b) the matched vessels being configured so the inner vessel is substantially upright and rotatable on its axis when at the bottom of the interior of the outer vessel;

(c) the outer vessel comprising a plurality of outcome elements on the outer vessel in a circular pattern concentric with the lateral wall of the outer vessel;

(d) the inner vessel comprising a plurality of congruent fins, each fin comprising a flat helical segment with an inner longitudinal edge adjoining an exterior surface of the lateral wall of the inner vessel and a free outer longitudinal edge; and (e) the inner vessel further comprising an outcome indicator on the lateral wall of the inner vessel, the outcome indicator aligning with an outcome element on the outer vessel when the inner vessel is at the bottom of the interior of the outer vessel.

2. The apparatus of claim 1, wherein the outer vessel comprises a height between one and a half times to eight times the height of the inner vessel and wherein the hollow interior of the outer vessel comprises a width that is greater than the external width of the inner vessel thereby allowing the inner vessel to fit upright inside the outer vessel, the width of the hollow interior of the outer vessel being no more than 50% greater than the external width of the inner vessel.

3. The apparatus of claim 2, wherein the lateral wall of the outer vessel extends upward from the circular edge of the bottom wall of the outer vessel at an outward angle of 1° relative to the axis of symmetry of the outer vessel to form a frusto-conical outer vessel comprising a bottom that is narrower than its top.

4. The apparatus of claim 3, wherein the outer vessel comprises a toroidal base encircling the lower portion of the outer vessel.

5. The apparatus of claim 4, wherein the plurality of outcome elements is disposed on the surface of the toroidal base.

6. The apparatus of claim 5, further comprising a plurality of boundary marks, each boundary mark being disposed between adjacent outcome elements on the surface of the toroidal base to segment the toroidal base into portions, each corresponding to an outcome element.

7. The apparatus of claim 2, wherein the plurality of outcome elements is disposed on the lateral wall of the outer vessel.

8. The apparatus of claim 3, wherein the bottom wall of the frusto-conical outer vessel is 4 inches wide and the circular open top of the frusto-conical outer vessel is 4.5 inches wide.

9. The apparatus of claim 8, wherein the inner vessel comprises four congruent, helical fins; and an outer cylindrical ring adjoining an upper portion of each fin to encircle at least a portion of the inner vessel, wherein (a) the inner vessel comprise a width four times the width of one of the helical fins; (b) each helical fin comprises a width between the inner and outer longitudinal edges of ½ an inch; and (c) the outer cylindrical ring comprising a width of 3.5 inches.

10. The apparatus of claim 3, wherein the outer vessel comprises a first alignment means centrally disposed on the interior surface of the bottom wall of the outer vessel and the inner vessel comprises a second alignment means centrally disposed on the exterior surface of the bottom wall of the inner vessel, the first and second alignment means comprising complementary surface contours that combine to limit rotation of the inner vessel when the inner vessel is in the outer vessel and at the bottom of the outer vessel.

11. The apparatus of claim 1, wherein each fin of the plurality of congruent fins comprises a curvature between 20° to 60° relative to the circular open top of the inner vessel.

12. The apparatus of claim 11, wherein each fin of the plurality of congruent fins comprises a width that is $1/4^{th}$ the width of the inner vessel.

13. The apparatus of claim 12, wherein the inner vessel comprises four horizontally, non-overlapping fins.

14. The apparatus of claim 11, wherein the inner vessel further comprises an outer cylindrical ring adjoining an upper portion of each fin of the plurality of congruent fins, the outer cylindrical ring encircling at least a portion of the inner vessel thereby forming the widest portion of the inner vessel.

15. The apparatus of claim 14, wherein the outer cylindrical ring is elevated relative to the inner vessel.

16. The apparatus of claim 14, wherein the outer cylindrical ring comprises a height that is half to one and a half the height of the inner vessel.

17. A game set comprising the apparatus of claim 1 and a plurality of playing cards, wherein at least one playing card of the plurality of playing cards comprises at least one outcome element of the plurality of outcome elements on the outer vessel.

18. A method for two or more players to play a game, the method comprising the steps of:

(a) providing the apparatus of claim 1;

(b) adding a select level of fluid to the hollow interior of the outer vessel;

(c) placing the inner vessel in the fluid in the outer vessel to allow the inner vessel to float; and (d) requiring each player in turn to add at least a drop of fluid to the inner vessel until a player causes the inner vessel to sink to the bottom of the outer vessel, wherein the player who causes the inner vessel to sink loses.

19. The method of claim 18, further comprising requiring the player who causes the inner vessel to sink to the bottom to draw a card from a plurality of playing cards, wherein at least one card of the plurality of playing cards comprise a textual description of an act to be performed by one or more of the players, and performing the act according to the textual description on the drawn card.

20. The method of claim 18, further comprising:

(a) establishing an act associated with each outcome element on the outer vessel, (b) determining which outcome element on the outer vessel is aligned with the outcome indicator on the inner vessel when the inner vessel is at the bottom of the outer vessel; and (c) requiring the player who causes the inner vessel to sink to the bottom to preform the act associated with the outcome element determined in step (b).

* * * * *